US005333202A

United States Patent [19]

Okaya, deceased et al.

[11] Patent Number: 5,333,202

[45] Date of Patent: Jul. 26, 1994

[54] MULTIDIMENSIONAL STEREOPHONIC SOUND REPRODUCTION SYSTEM

[76] Inventors: Akira Okaya, deceased, late of New Canaan, Conn.; Ken Okaya, executor, 1012 Brodie St., Austin, Tex. 78704

[21] Appl. No.: 906,280

[22] Filed: Jun. 29, 1992

Related U.S. Application Data

[63] Continuation-in-part of Ser. No. 204,653, Jun. 9, 1988, abandoned.

[51] Int. Cl.[5] ..... H04R 5/02

[52] U.S. Cl. ..... 381/24; 352/11

[58] Field of Search ..... 359/444, 445; 352/11; 381/24, 85, 90, 188, 205

[56] References Cited

U.S. PATENT DOCUMENTS

| | | | |
|---|---|---|---|
| 1,942,068 | 1/1934 | Owens . | |
| 1,997,815 | 4/1935 | Edelman . | |
| 2,047,290 | 7/1936 | Ringel | 359/444 |
| 2,133,097 | 10/1938 | Hurley | 359/444 |
| 2,187,904 | 1/1940 | Hurley | 359/445 |
| 2,238,365 | 4/1941 | Hurley | 359/445 |
| 2,826,112 | 3/1958 | Mueller | 352/11 |
| 2,940,356 | 6/1960 | Volkmann | 352/11 |
| 3,449,519 | 6/1969 | Mowry . | |
| 3,572,916 | 3/1971 | Belton, Jr. . | |
| 3,696,698 | 10/1972 | Kaminsky . | |
| 3,759,345 | 9/1973 | Borisenko . | |
| 3,933,219 | 1/1976 | Butler . | |
| 3,964,571 | 6/1976 | Snell . | |
| 4,119,798 | 10/1978 | Iwahara | 381/26 |
| 4,196,790 | 4/1980 | Reams . | |
| 4,452,333 | 6/1984 | Peavey et al. . | |
| 4,503,930 | 3/1985 | McDowell . | |
| 4,507,816 | 4/1985 | Smith, Jr. | 381/151 |
| 4,569,076 | 2/1986 | Holman | 381/90 |
| 4,629,030 | 12/1986 | Ferralli . | |
| 4,819,269 | 4/1989 | Klayman | 381/24 |

OTHER PUBLICATIONS

R. A. Fisher (1983), "Optical Phase Conjugate", Academic Press, NY.

F. Fahy (1985), "Sound Structural Vibration", Academic Press, NY.

H. Stark ed (1982), "Applications of Optical Fourier Transforms", Academic Press, NY.

"Nonlinear Effects in Image Formation", H. J. Gerritsen; RCA Labs, Princeton, N.J. Applied Physics Letters 1 May 1967 pp. 239-241.

"Coupled-Wave Analysis of Holographic Storage in $LiNbO_3$", Staebler et al RCA Labs, Princeton, N.J. J. Appl. Phys. vol. 43, No. 3, Mar. 72 p. 1042.

"Time-domain Signal Processing via Four-Wave Mixing in Nonlinear Delay Lines", O'Meara et al Hughes Research Labs, Optical Engineering Mar./Apr. 1982/vol. 21, No. 2, pp. 237-242.

*Primary Examiner*—Forester W. Isen

*Attorney, Agent, or Firm*—Jones, Tullar & Cooper

[57] ABSTRACT

A system which provides a means for reproducing stereophonic prerecorded sound which greatly improves the quality of the reproduced sound which the listener hears is disclosed. The sounds reproduced through the system of the present invention closely emulate the sounds as originally generated by the sound source, particularly with regard to the locations of the sound sources relative to one another.

Through the method and apparatus of the present invention, the sounds emanating from the sound transducers, which comprise sound waves travelling through air, are transformed on a sound-receiving surface of a sympathetically vibratable material or "sound screen" into surface forced bending waves within the material which travel along the surface towards one another. These waves combine and interfere with one another thereby producing an acoustic-to-acoustic transducer which has the form of an acoustic grating pattern formed from standing waves on the material, where each acoustic grating pattern on the sound screen corresponds to and represents a given sound source. The grating pattern, like the diaphragm of a speaker cone, produces sounds which emulate the individual sound sources.

9 Claims, 19 Drawing Sheets

FIG. 7
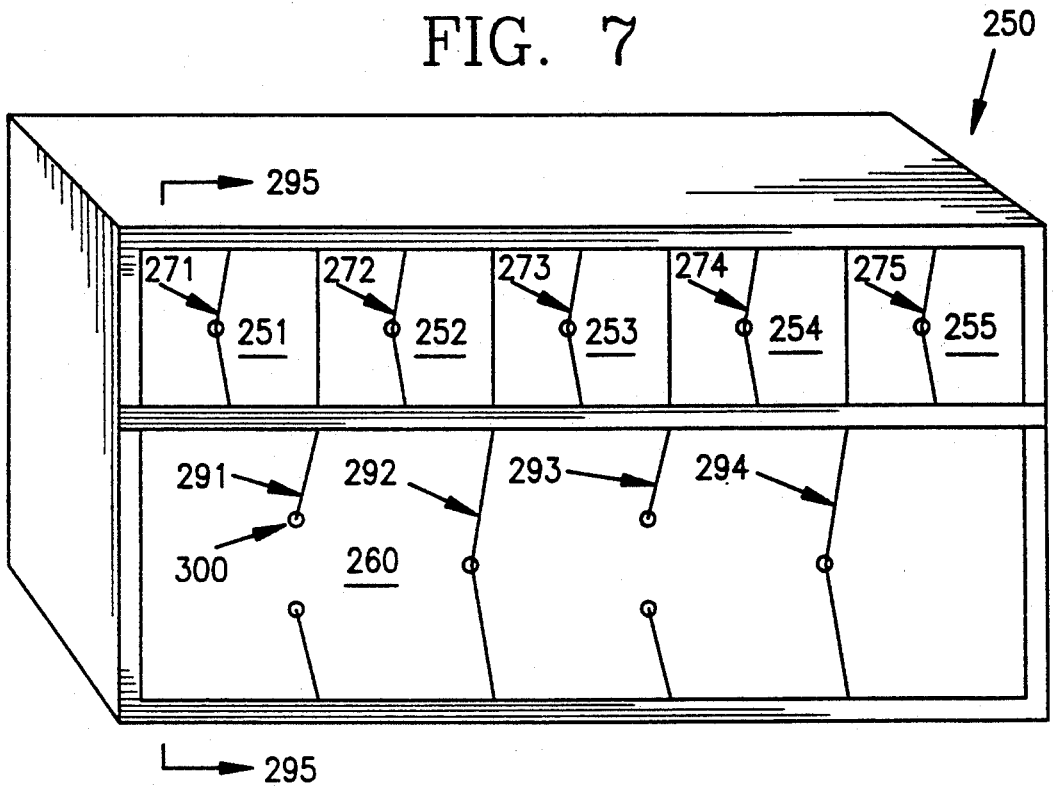
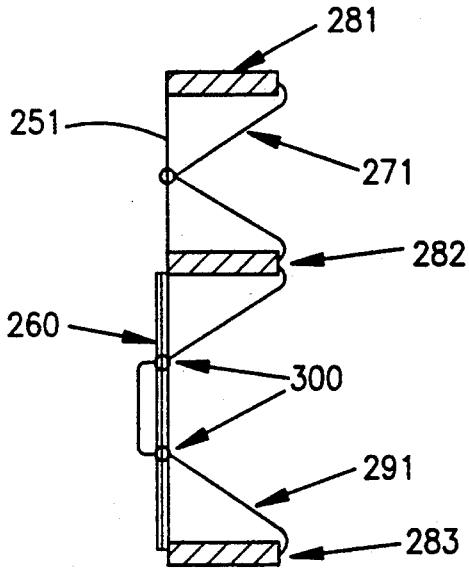
FIG. 8

FIG. 21
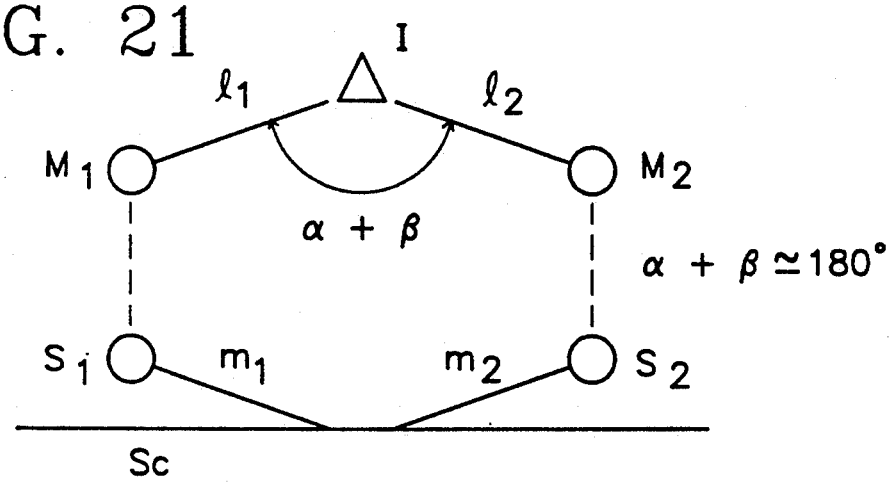
FIG. 22
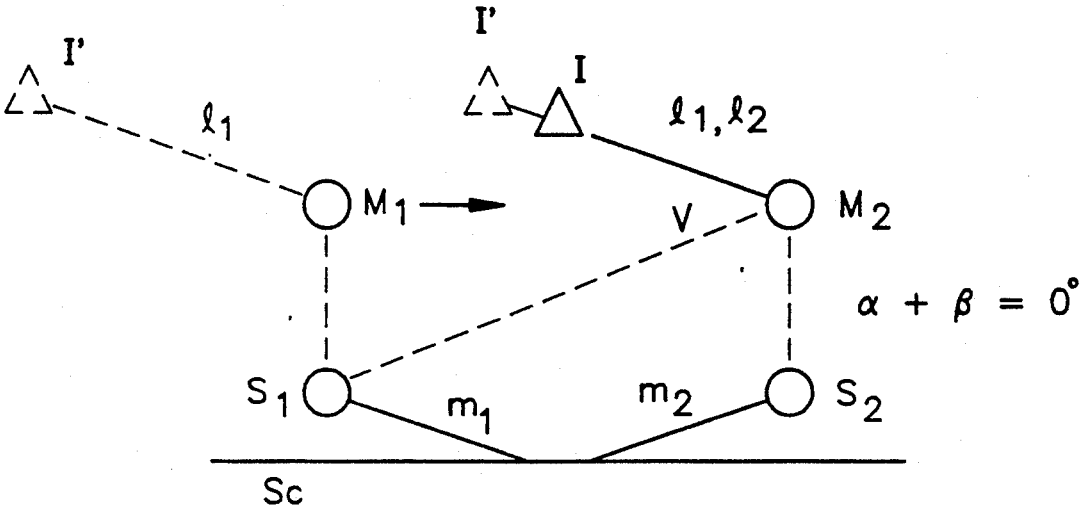
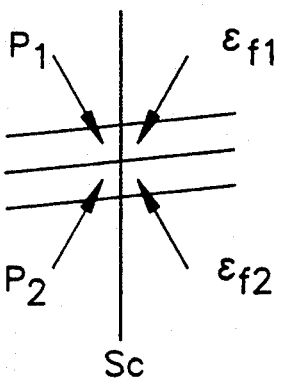
FIG. 23
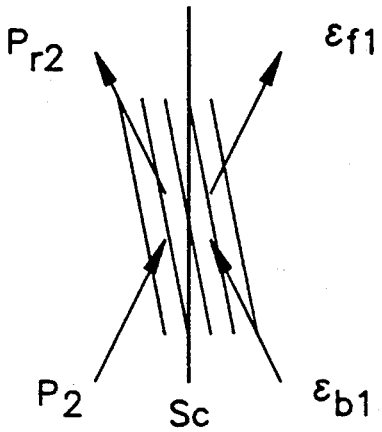
FIG. 24

FIG. 33
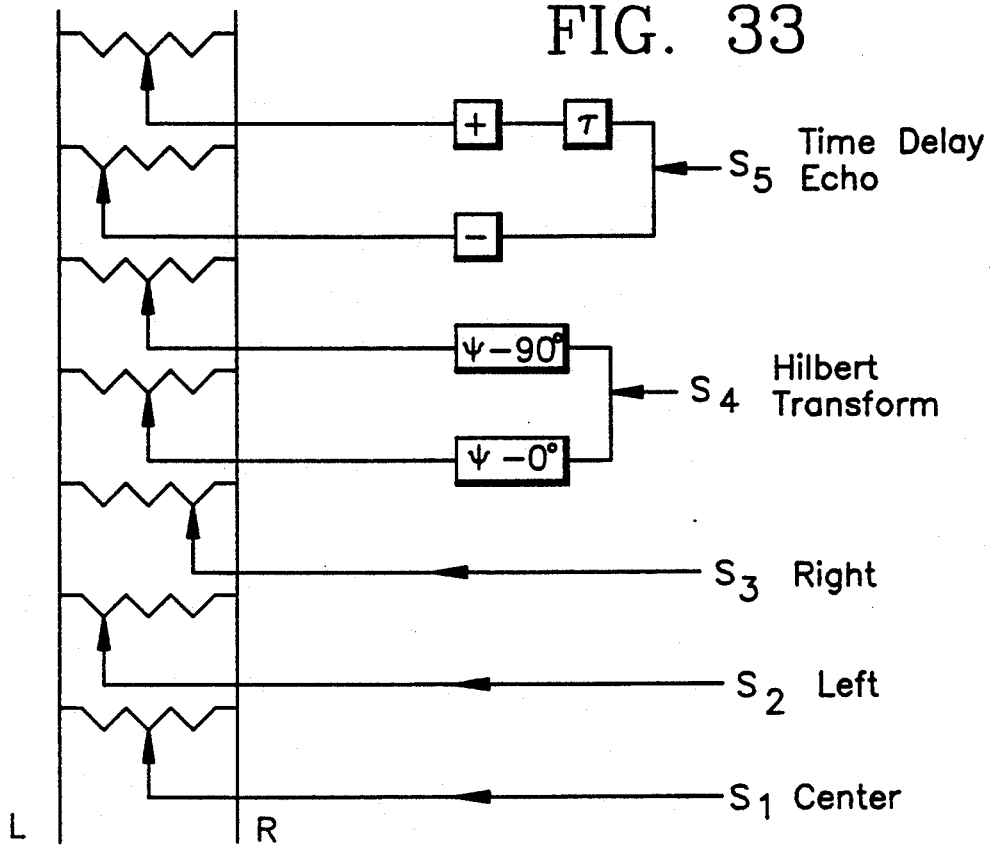
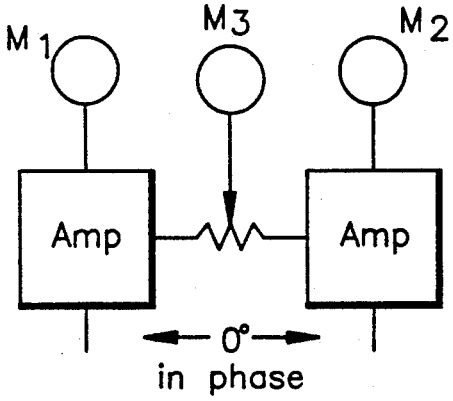
FIG. 34
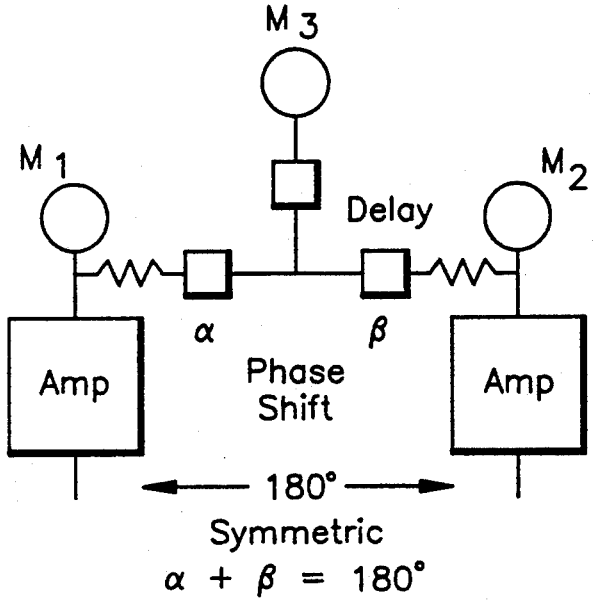
FIG. 35

MULTIDIMENSIONAL STEREOPHONIC SOUND REPRODUCTION SYSTEM

This is a continuation-in-part of Ser. No. 07/204,653 filed Jun. 9, 1988, now abandoned.

FIELD OF THE INVENTION

The present invention relates to the reproduction of multidimensional sound in front of a listener. More particularly, it relates to a novel system and method for the emulation of the relative spatial positioning of sound sources (e.g. musical instruments or voices) recorded or broadcast by conventional stereophonic equipment.

BACKGROUND OF THE INVENTION

A person attending a "live" performance at an orchestral hall will hear many different sounds at the same time, for example, sounds originating from strings, wind or percussion instruments and voices. When listening to live music, the listener not only hears the individual sounds emanating from the musical instruments and/or singers, but also senses the specific locations where the instruments and/or singers are located. For example, the listener would hear the sounds generated by the french horns emanating from the right side of the stage where the french horn section is located, the sounds generated by the violins emanating from the center of the stage where the violins are located, and sounds generated by the tympani on the left where the percussion section is located. This aspect of determining the relative location of the instruments will be referred to herein as three-dimensional sound.

The concept of stereophony was introduced in an attempt to emulate in a listening room with a prerecorded or broadcast sound source the three-dimensional sound that would have been heard during a live performance of the same program.

In stereophony, a sound is typically recorded stereophonically by recording on separate, individual channels the sounds received by each of a plurality of microphones located at predetermined positions in the recording studio or concert hall. The sounds can be recorded on media such as a record, tape or compact disc. The recorded sound can subsequently be reproduced on a stereophonic or two-channel reproduction system such as a home stereo system. A home stereo system typically comprises a means for reading the sound information in the individual channels stored on the media, and generating electric signals representative of the information. The electronic signals are amplified and fed to electronic-to-acoustic transducers, such as loudspeakers, to generate the sound waves which the listener then hears.

It is desirable that the recorded sound reproduced on a stereo system sounds the same as the original sounds. In an attempt to achieve the best possible sound quality, stereo speakers are typically positioned a distance apart from one another. This is illustrated in FIG. 1. Instruments 11, 12 and 13 which, in this example produce music, are positioned at locations 10, 12 and 14 in a recording studio 16. Also situated in the recording studio 16 are two microphones $M_1$ and $M_2$ positioned at locations 18 and 20. The microphones $M_1$ and $M_2$ provide the means to record the sounds received at locations 18 and 20. Electrical signals representative of the sounds received through the microphones $M_1$ and $M_2$ are recorded on separate channels by sound recording and reproductions unit 22. In listening room 24, the sound recording and reproduction unit 22 is connected to speakers $S_1$ and $S_2$ at locations 26 and 28. Speakers $S_1$ and $S_2$ are positioned apart from one another in simulation of the separation of microphones $M_1$ and $M_2$. Speaker $S_1$ reproduces the sounds recorded from microphone $M_1$and speaker $S_2$ reproduces the sounds recorded from microphone $M_2$. Thus, theoretically, the listener, positioned at location 30, would expect to hear the reproduced music from 12 with the same sensation if as being in the recording studio if the separation of speakers $S_1$and $S_2$ is equal to that of microphones $M_1$ and $M_2$, and the relative position of the ear 30 to the speakers $S_1$ and $S_2$ is equal to the relative position of the sound source 12 to $M_1$ and $M_2$. Each sound source 11, 12, and 13 has a different singular ear position 30 for ideal sound reproduction. In reality, however, the listener instead hears instruments 11, 12 and 13 originating simultaneously from both speakers. This produces artificial, distorted sounds because each of the original sounds, emanating from instruments 11, 12 and 13, originates from an individual distinct location 10, 12 and 14, respectively, dictated by the positions of the instruments, not from two separate locations as the listener perceives through the conventional stereophonic sound reproduction system. More specifically, the listener in the listening room hears a mixture of two distinct sources of sound from two speakers representative of the combination of microphones/speakers, $M_1/S_1$ and $M_2/S_2$, which transmit the combination of sounds originating from each point source 11, 12 and 13.

Some improvement in the reduction of such distortion of reproduced sound can be achieved through the use of stereo headphones. Since the sounds out of the right and left speakers are fed directly and exclusively into the respective right and left ears of the listener, the mixing of sounds from the right and left speakers is substantially eliminated. However, the real situation is not completely emulated and the listener cannot discern the relative position of the individual sound sources.

For the accurate reproduction of sound, the listener should be able to hear three distinct sources of sounds, (i.e., the instruments) as well as the locations of the sound sources relative to one another (since that is what the listener would hear if he were listening to a "live" performance, that is, if the listener were physically located in front of sound producing instruments 11, 12 and 13).

SUMMARY OF THE INVENTION

Accordingly, it is an object of the present invention to provide a system of stereophonic sound reproduction which permits a greater degree of freedom from distortion in the perceived relative locations of the individual instruments than was heretofore possible in conventional listening room.

Another object is to provide an apparatus for achieving according to the system of the invention the stereophonic reproduction of prerecorded or broadcast sound having a greater degree of freedom from distortion in the perceived relative locations of the individual sound sources than was heretofore possible in conventional listening rooms.

A further object of the invention is to provide a multidimensional recording and broadcasting system for sound reproduction having proper phase characteristics.

Yet another object of the invention is to provide a method of stereophonic sound reproduction in the listening room which is comparatively free of distortion in the listener-perceived location and tonality of the individual sound sources.

The foregoing objects are achieved according to the present invention by means of a system which provides a means for recording, broadcasting and reproducing stereophonic prerecorded and broadcast sound which greatly improves the quality of the reproduced sound which the listener hears. The sounds reproduced through the system of the present invention closely emulate the sounds as originally generated by the sound source, particularly with regard to the locations of the sound sources relative to one another.

Through the method and apparatus of the present invention, the sounds emanating from the sound transducers, which comprise sound waves travelling through air, are transformed on a sound-receiving surface of a sympathetically vibratable material or "sound screen" into forced bending waves of the screen material which propagate along the surface towards one another. These waves combine and interfere with one another thereby producing an acoustic-to-acoustic transducer which is an active acoustic grating formed from standing waves on the screen material, where each acoustic grating pattern on the sound screen corresponds to and represents a given sound source. The location on the sound screen of each of the acoustic grating patterns corresponds to the relative position of the original sound source. The grating pattern on the screen produces sounds which emulate the individual sound sources. Not only does the listener distinctly hear the original sound sources, but the listener can also perceive the relative positions of the original sound sources as the listener would be able to do if he were listening to "live" music.

BRIEF DESCRIPTION OF THE DRAWINGS

The features and advantages of the invention will be more readily apparent from the following drawings wherein:

FIG. 7 illustrates the presently preferred embodiment of the invention.

FIG. 8 illustrates the preferred embodiment in section.

FIGS. 21 and 22 illustrate the differences of wave characteristics between two cases, the first where microphones $M_1$ and $M_2$ are 180 degrees out of phase, and the second where vectors 11 and 12 overlap.

FIGS. 23 and 24 illustrate the effect of sound waves impinging upon a sound screen.

FIG. 33 illustrates a conventional recording system.

FIG. 34 illustrates a con ventional recording configuration for which microphones $M_1$, $M_2$ and $M_3$ are in phase.

FIG. 35 illustrates a phase conjugate configuration in accordance with the present invention.

DETAILED DESCRIPTION

Through the system of the present invention, the quality of reproduced stereophonic media is improved to an extent such that the reproduction in senses and perceived by the listener as being "live" rather than prerecorded. Not only does the system of the present invention emulate each original individual sound source, but it also emulates said sources at the same relative locations as the original sound sources. Thus, if the original sound sources are a violin situated on the left, a drum situated on the right, and a piano situated between the drum and violin, the listener will perceive three distinct sources of sounds, a violin, drum and piano, the violin emanating from the left, the drum emanating from the right and the piano emanating from a location between the violin and drum.

Figure 1:
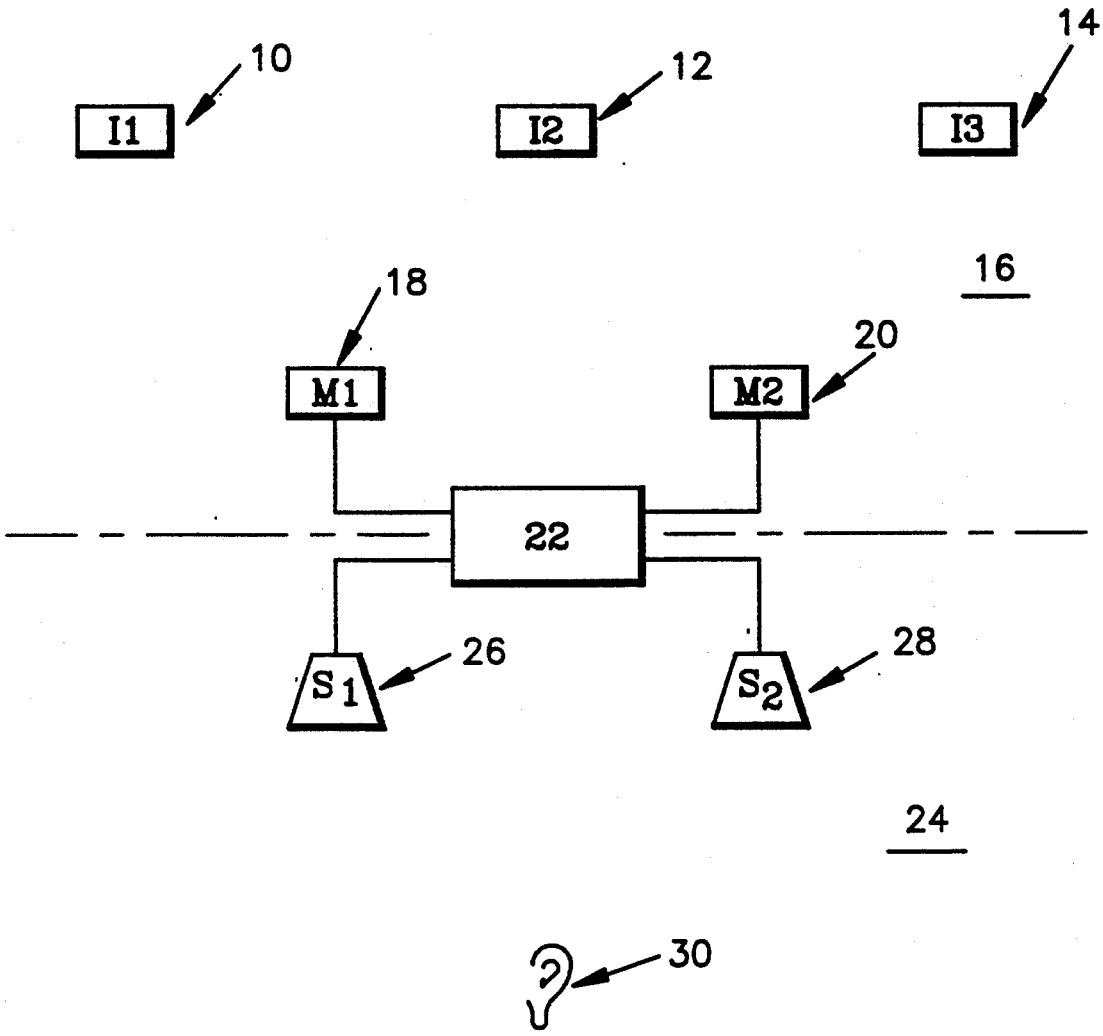
FIG. 1 illustrates schematically the physical layout of a recording studio and listening room, as discussed hereinabove.
Figure 2:
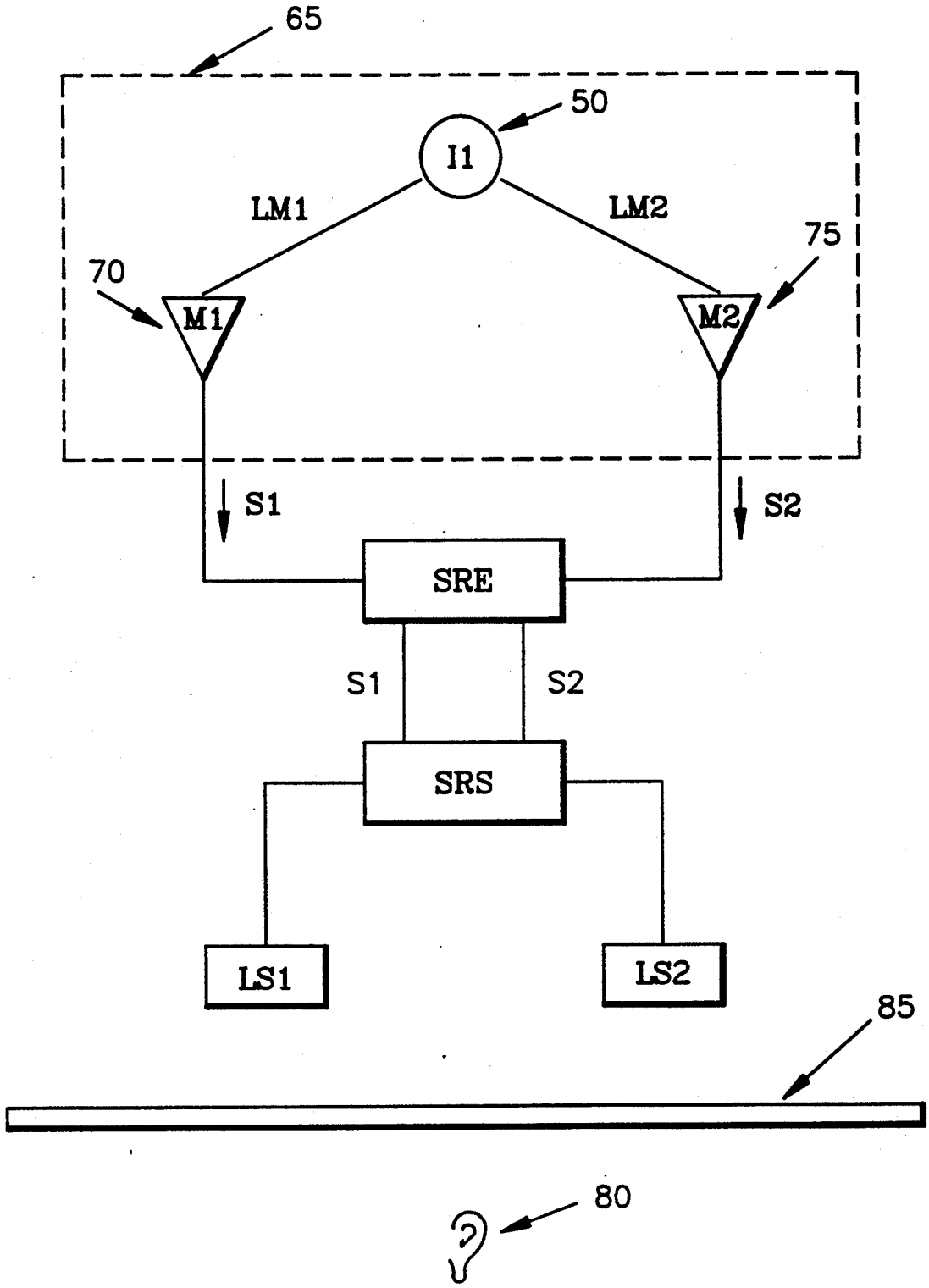
FIG. 2 illustrates schematically an embodiment of the system of the present invention.

The present invention is illustrated schematically in FIG. 2. In this illustration, the original sound source, a single musical instrument 11, is located at position 50 in recording studio 65. Microphones $M_1$ and $M_2$ are located in the recording studio 65 at locations 70 and 75, and at distances $LM_1$ and $LM_2$ from the sound source 11, respectively. The microphones $M_1$ and $M_2$detect the sound waves as they exist at the locations 70 and 75, respectively, and convert the sound waves into electronic signals $S_1$ and $S_2$. The electric signals $S_1$ and $S_2$ can be recorded using stereophonic recording and broadcasting equipment SRE and reproduced for listening from transducers similar to loud speakers $LS_1$ and $LS_2$ through a stereophonic reproduction system SRS such as are found in the home.

The sound waves sensed at microphones $M_1$ and $M_2$ originate from a single sound source 11 at a single position 50. Without using the method and apparatus of the present invention a listener located at 80 will concurrently hear multiple sounds from two left and right sound sources, speakers $LS_1$ and $LS_2$, even though the original sound source was only a single instrument 11. Therefore, instead of hearing a single sound source the listener hears two sound sources which mix with one another to produce artificial, distorted sound by interference.

In the method of the present invention, the sound waves originating from transducers $LS_1$ and $LS_2$ are caused to interfere with one another on the sound-receiving screen of a sympathetically vibratable material or "sound screen" 85 prior to reaching the listener at 80. In this way, the incident diffused sound waves from the transducers $LS_1$ and $LS_2$ constructively create interference with one another on the sound screen 85, thereby generating standing waves on the sound screen. The standing waves of the sound screen correspond to the vibrating of the speaker cone, which emulates the sound of the original sound source.

Generally, the size of the sound generating area for a musical instrument is comparable to the wavelength of the sound waves in the air generated by it, and therefore can be considered, in the present context, as equivalent to a point sound source. Similarly, microphones $M_1$ and $M_2$ and transducers $LS_1$ and $LS_2$ may each be considered equivalent to point sources. Thus, the effect of wave interference which occurs with the incident diffused sound waves from the transducers $LS_1$ and $LS_2$ can be analogized to the interference effect of light waves as illustrated in the cases of Young's experiment and optical holographs. Those famous experiments, described in most physics textbooks, confirm the nature of conjugated waves. In Young's experiment, a point source of light illuminates two parallel slits spaced a small distance apart. According to Fermat's and Huygen's Principles in Optics, two slits function as two separated phase-conjugated light sources because the light originates from one light point source. The light emitted from the two slits is projected onto a screen placed behind the slits; and they show a light wave interference pattern. If the light source is moved parallel to the slit plane, then the interference pattern moves synchronously and in the opposite direction, the direction of the light beam is straight.

The interference effect illustrated by Young's experiment can be applied to sound waves. As discussed earlier, the original sound source 11, microphones $M_1$ and $M_2$, and transducers $LS_1$ and $LS_2$are considered point sources and therefore the sound waves emitted from the transducers exhibit phase conjugated properties. The Applicant's stereophonic recording and reproduction unit will maintain the acoustic phase frequency and amplitude relationships of the original sounds. However, in conventional systems, the distance from the speakers at which the effects of interference are manifested in the human ear depends on several variables, such as the frequency, location, and time occurrence of the sound at the source. This creates very complex interference patterns which give rise to distortion in the sound heard by the listener. Because music comprises sounds covering a broad range of frequencies and phases, there is no particular distance from and location in relationship to the speakers at which the listener may hear the same constructive interference effects by location and time of occurrence with respect to all the sounds which comprise the music.

Thus, by causing the incident diffused sound waves emitted from the transducers $LS_1$ and $LS_2$ to interfere with one another on the sound screen before they reach the listener, resultant standing waves are produced on the sound screen which correspond to the original sound source, and drive an acoustic-to-acoustic transducer from which the quality of sound emitted closely emulates that of the original sound source. Thus, the one dimensional horizontal position of the original sound source is retrieved at the horizontal listening room.

Figure 3:
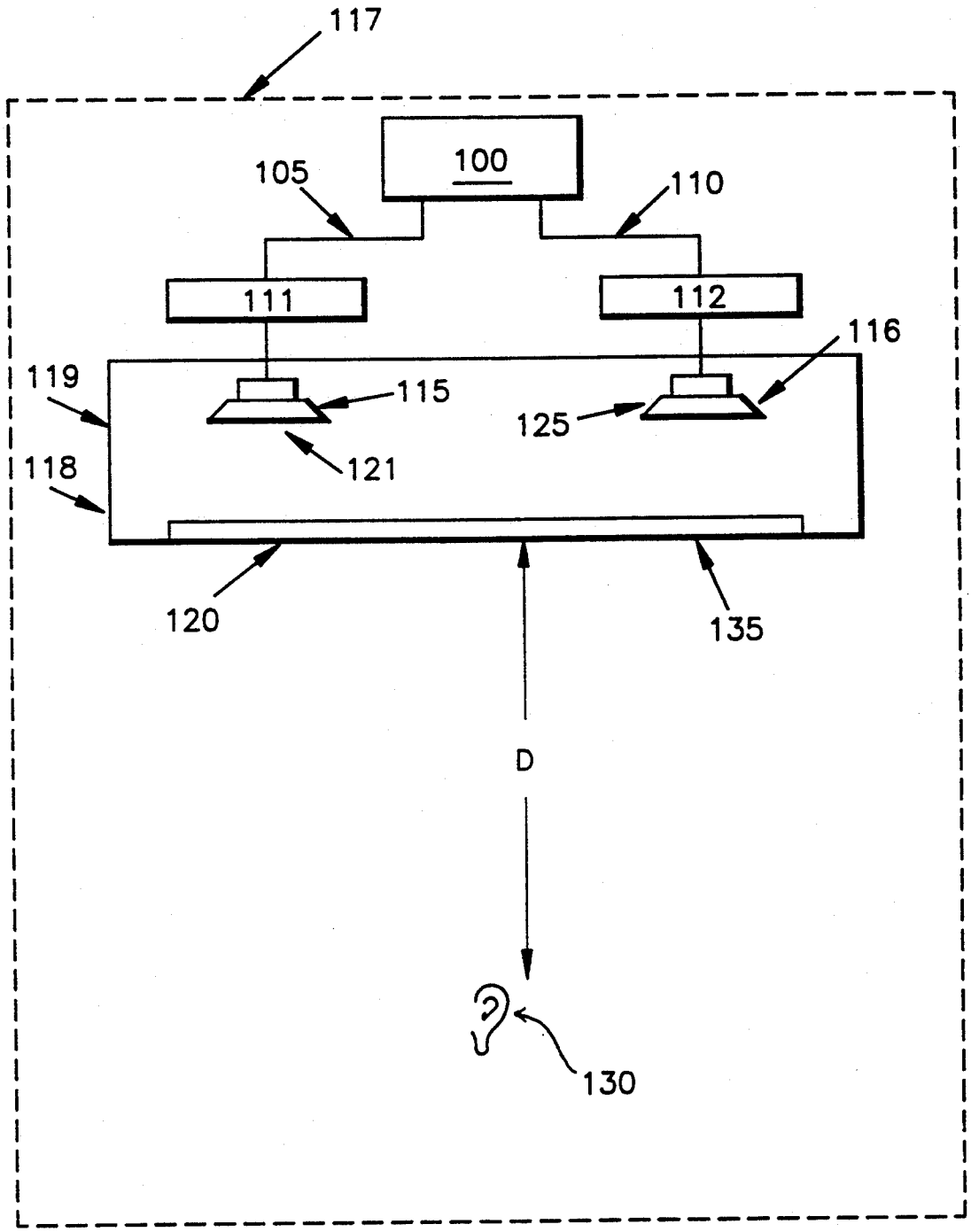
FIG. 3 illustrates another schematic embodiment of the system of the present invention.

A preferred embodiment of the invention is illustrated in FIG. 3. Stereophonic sound reproduction equipment 100 such as a record player, tape player or a compact and laser disc player outputs from a left 105 and right 110 channel. The electronic signals are amplified in amplification means 111 and 112 and used to drive electronic-acoustic transducers 115 and 116 located in listening room 117. The transducers 115 and 116 convert the electronic signals to sounds.

To accomplish the objects of the invention, the effective transducer cone diameter should be rather small, such that the acoustic impedance of moving coil waves matches to sound screen acoustic suspended by space resonator 118 which comprises a cabinet 119, sound screen 120 and two left and right transducers 115 and 116 at locations 121 and 125. Conventional speakers which have large cone diameters are less desirable for use in the system of the present invention even at low frequency ranges, because the sound screen 120 and the enclosure cabinet 119 form a very wide frequency range acoustic impedance transformer to free space impedance. The matching of two transducers characteristics is not critical as has been the case in conventional stereo systems due to the existence of transformer. The sound output from sound screen 120 is uniform over most of the surface thereof due to the fact that standing waves on the sound screen possess compositive sound characteristics of the two transducers 115 and 116, the sound screen 120 and enclosure cabinet 119. If one were to calculate the low frequency limit of this invention roughly from the dimension ratio between a conventional speaker cone diameter and the horizontal dimension of sound screen 120 one could obtain the following number: conventional woofer speaker diameter 12 inches (freq. limit around 30 Hz) and typical horizontal dimension of a sound screen is approximately 5 feet.

Low frequency limit of sound screen $f_{low}$ $$f_{low}=30\times 12/60=6H_z$$

In this invention, the low frequency response limit is no longer dependent on the acoustic characteristics of the transducers 115 and 116.

With regard to high frequency response limit, the improvement in tonality in the high audio frequency range is significant because the non-linear characteristics of sound screen vibrations known from fundamental mechanical theory of thing plate vibration provide even higher harmonic wave generations of musical instrument and voice sound. The transducers 115 and 116 are preferably small in diameter compared to that of conventional speakers; and they function as equivalents of a point source whereby the effect of subsequently generated standing wave is at a maximum, but a speaker cone of conventional stereophonic equipment can be used. To drive the sound screen 120, stiff cones are preferred to balance out with the impedance of the stretched source screen. However, the diameter of the transducers should be sufficient to provide the proper response at low frequencies.

The transducers 115 and 116 are positioned at locations 121 and 125 which preferably correspond to the relative positions of the microphones through which the original sounds were initially recorded. The emulation of "concert hall ambience" is achieved by the system of the present invention notwithstanding the fact that the separation of the transducers may differ from the separation of the microphones. Indeed, in actual practice, the separation of the transducers is substantially less than that of the microphones. The listener is positioned a distance "D" away at location 130. Sound screen 120 is placed between the transducers 115 and 116 and the listener at 130. The screen 120, at location 135 must be of a size and shape and be located such that the listener hears the enhanced sounds which totally emanate from the screen. The width of sound screen 120 is at least as great as the separation between the transducers; and, often, the separation of the sound screen from the transducers is less than the separation between the transducers to emulate the configuration in the studio. When two microphones are placed closer together than the separation between sound source 11 and microphones 70,75, the screen size could be several times greater than the separation of transducers 115 and 116; and screen 85 could be placed a much longer distance away than the distance separating transducers 115 and 116.

The screen 120 can be of any rectilinear shape; however it is preferred that the screen be constructed in a rectangular or oblong shape. The screen can optionally be constructed in a non-planar elliptical or ellipsoidal shape surrounding the transducers thereby optimizing the acoustic interaction between the sound waves generated by transducers 115 and 116.

Thus, the screen 120 must be located at 135 in the path of the sound waves emanating from the transducers 115 and 116 so as to intercept the sound waves before they reach the listener to insure that only the sound waves emanating from the sound screen 120 are heard by the listener.

The sound screen 120 may consist of many types of compositions of combinations thereof. For example, the screen may be constructed of stiff woven fabric or a combination of fabric and aluminum foil.

The characteristics and the thickness of the material which form the screen dictate the range of frequency responses and therefore often the type of music which the screen is best suited for. A number of parameters contribute to the acoustical response of the material, including the local flexibility and over all rigidity of the material. For example, a cloth which is tightly stretched over a frame will have a higher frequency response than the same cloth placed loosely on the same frame. The applicant has found that a variety of materials from cloth to metal to ceramics and their compositive materials may be used to achieve different responses- For example, materials such as cotton, linen, fiberglass and other metal, glass, plastic and their compositive artificial fibers can be used. It has been found that the thinner the material, the higher the frequency response. This also relates to the diameter of the thread, the tightness of the weave as well as the overall physical characteristics of the material itself. Foils made out of aluminum or other metals or alloys as well as silver, copper and zinc perform well in the high frequency range. In addition, metal, crystal, ceramic-coated films, diamond, alumina, and zirconia can be used. The acoustic response of the woven materials does change somewhat by placing a coating on top of the woven material. Suitable coatings include varnish, lacquer, paint and epoxy as well as enamel.

Although the screen can be homogeneous, the sound screen may be sectioned into separate areas whereby different areas are more responsive to different frequency ranges. For example, the upper portion of the screen may be aluminum foil with an extremely high frequency response to best react with the high frequency sounds. The middle portion of the screen can comprise a paint coated fabric which does well in the mid-ranges of frequencies and the lower portion of the screen may consist of a loosely woven but harder material which is best responsive to the low frequency sounds.

The sound screen 120 provides a medium which intercepts the sound waves emitted from transducers 115 and 116 and permits the constructive interference of the sounds generated by the individual sound source (i.e., instruments) which results in the output of enhanced stereophonic sound. The enhanced sounds not only sound better, but the relative positions of the original sound sources with respect to the microphones is emulated for each sound source. For example, if the sounds reproduced originated from a five piece band, five different sound sources would emanate from the sound screen, each one originating from a different piece of the band.

Figure 4:
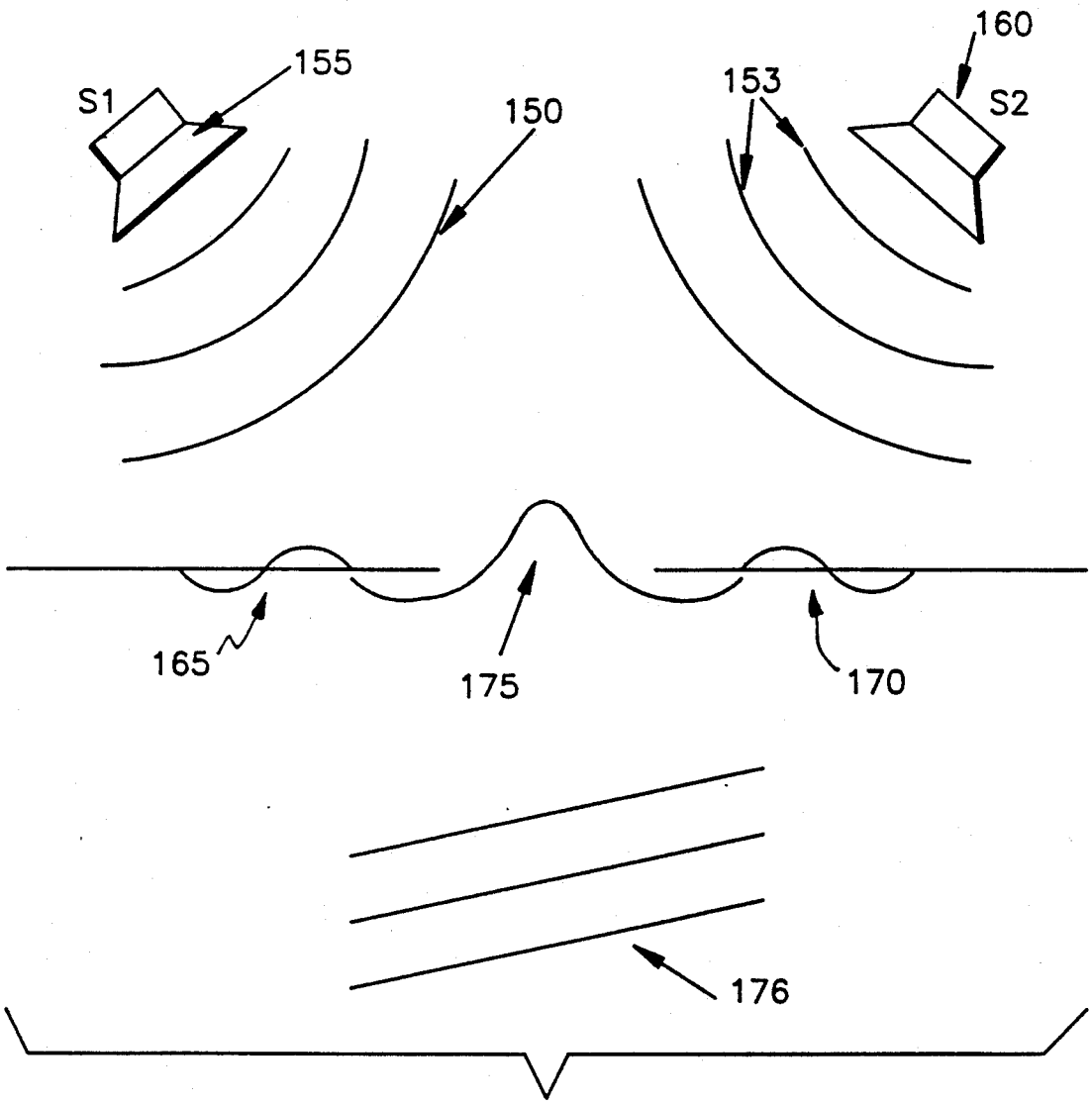
FIG. 4 illustrates the formation of a standing wave from interfering forced bending waves on the sound screen.

More particularly, referring to FIG. 4, the incident travelling waves 150 and 153 from transducers $S_1$ at 155 and $S_2$ and 160 are converted to forced bending waves 165 and 170 when the incident travelling waves 150 and 153 impinge upon the screen.

The incident travelling waves 150 and 153 may impinge upon the screen with relative phase, such relative phase determining the direction of phase wave front 176 of output wave 175 due to the conjugate phase characteristics of both waves originating from the same single sound point source (referring to Young's experiment). The surface forced bending wave 165 and 170 retain the same frequency and relative phase characteristics of the incident sound waves.

The surface forced bending waves will create standing waves in the screen and the standing waves thus created interfere with on another within the screen to produce an acoustic grating pattern holograph 175 which reradiates the sound toward the listener. The mechanisms for creation of this acoustical grating pattern are further explained below.

The location of the acoustical grating pattern holograph corresponds to the position of the original single sound source with respect to the microphones. This interference causes the holograph on the screen to vibrate at the frequencies of the original sound source and thereby produces the image of point source sounds which closely emulate the original sound point source at relative locations which correspond to the relative locations of the original sound sources.

In the preferred embodiment, however, left and right channel electronic circuits which include transducers 155 and 160 produce signals 150 and 153 which are 180° out of phase. This may be accomplished by switching the electrical connections of one speaker. This will produce phase conjugated force bending waves in the screen.

Figure 5:
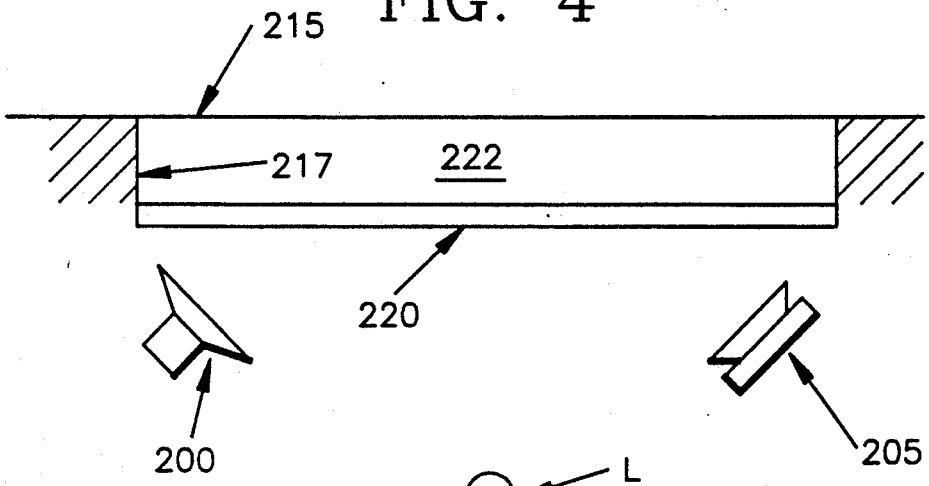
FIG. 5 illustrates another embodiment of the system of the present invention.

Another embodiment of the present invention is designated in FIG. 5. In this embodiment, acoustic transducers $S_1$ at 200 and $S_2$ at 205 are positioned to face in a direction opposite to the listener "L" at 210. However, the transducers 200 and 205 are positioned such that the acoustic outputs of the transducers travel in a direction towards an obstruction such as a wall 215 which comprises a rigid or solid (dense) material such as concrete. The sound screen 220 is placed between the wall 215 and the transducers 200 and 205 such at the sound screen 220 intercepts the sound waves from transducers $S_1$ and $S_2$ prior to reaching the wall 215. An air gap 222 provided between the sound screen 220 and the wall 215 changes the acoustic impedance of screen 220. The resulting enhanced sound waves comprising individual sound point sources emanate from the sound screen 220 in a direction toward the wall 215. Those sound waves are then reflected off the wall toward the listener depending upon the combined local acoustic impedances of the screen 220 and wall 215. Most of the sound listener 210 hears is from the acoustical grating pattern holograph created by forced bending waves on screen 222 by transducers positioned at 200 and 205. Closing up the gap between 215 and 220 by the wall 217 changes the acoustic impedance of screen 220 toward better low frequency response. This reflector arrangement is preferably used for a large audience.

Figure 6:
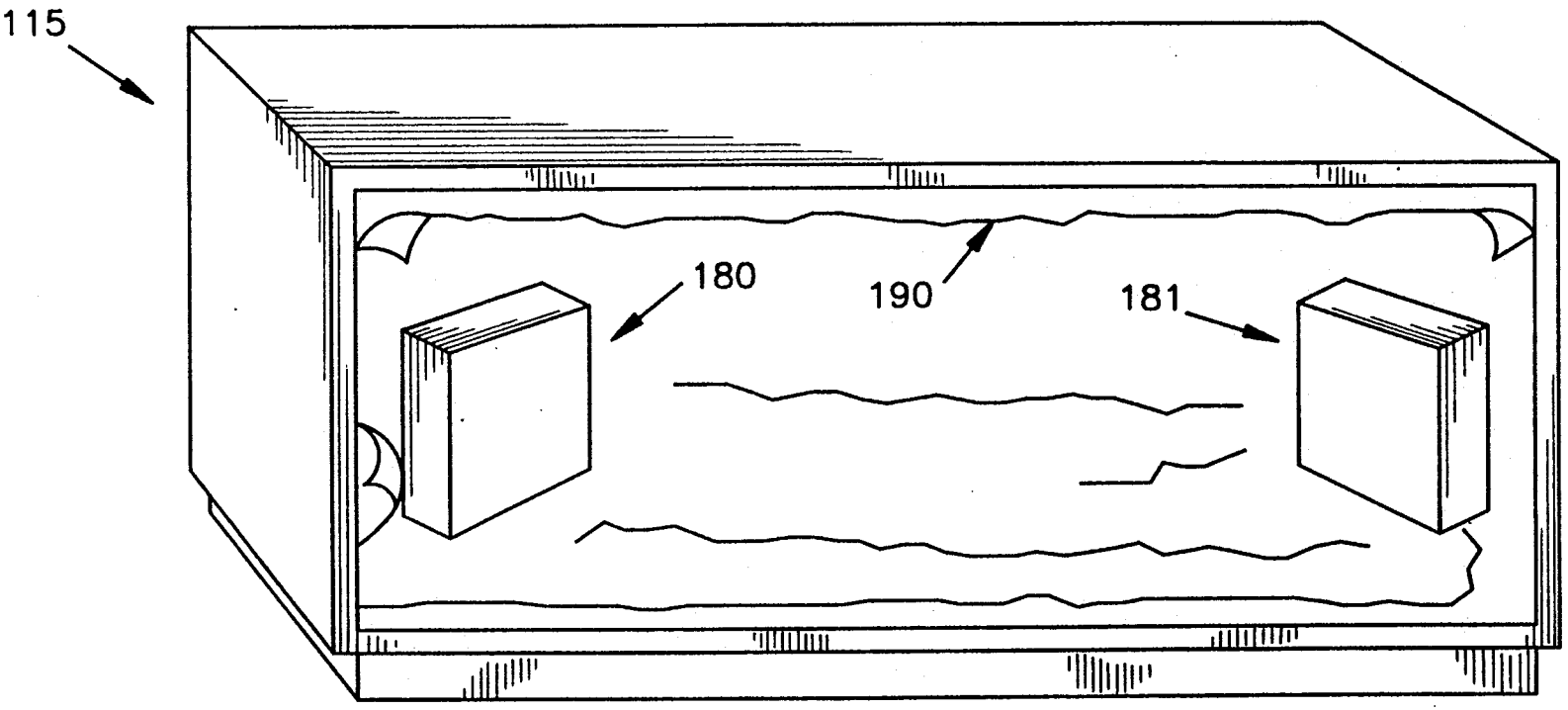
FIG. 6 illustrates a self-contained embodiment of the system of the present invention.

A speaker box-like arrangement is illustrated in FIG. 6. In this embodiment, two acoustic transducers 180 and 181 such as small area diaphragm transducers cones are placed in an enclosed case such as a wooden cabinet or box 175. The axes of the transducers are intersecting at an angle to assure the overlap of their respective sound waves over the entire surfaces of sound screen 190. This results in a self-contained unit. The size of the unit varies according to the size of the transducers, requirements on stereo sensation, tone quality and sound image resolution. In general, better results are obtained with a horizontally long and large volume cabinet.

Figure 9:
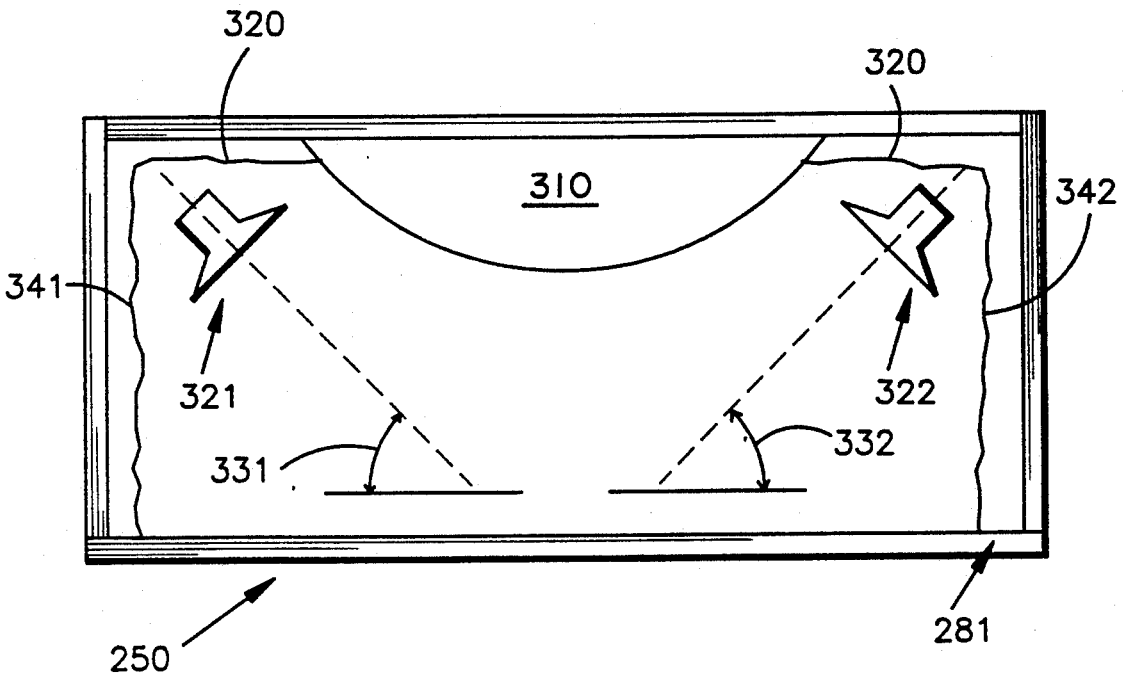
FIG. 9 illustrates the interior of the preferred embodiment.

In one preferred embodiment, shown in FIGS. 7, 8 and 9, the sound screen 250 has a segmented aluminum foil high frequency section with segments 251–255, and a canvas low frequency section 260.

FIG. 8 shows a section along 295 —295 of FIG. 7.

The high frequency sections 251–255 are kept under tension with rubber strips 271–275 or springs having ends which are fixed to frame members 281 and 282 and attached to the aluminum foil section segments 251–255 near the segment center.

The low frequency section 260 is kept under tension with lines 291–294, which may be strung through holes 300 in the canvas or attached to the canvas and fixed under tension to frame members 282,283.

The purpose of supporting the screen at so many points by springs 271–275 and wires 291–294 is to create the tension on the screen horizontally while making the vertical position of the screen more rigid so that the least amount of displacement due to vertical pressure waves is converted to force bending waves.

FIG. 9 shows a view into the top of the preferred embodiment.

Transducers 321, 322 are positioned behind the sound screen 250 and are aimed at angles 331,332 toward the screen. Preferably, angles 331 and 332 are in the range of 20°~60° depending on the recording configurations.

A sound insulating material 310, e.g. fiberglass, is interposed between loudspeakers 321,322 to prevent direct acoustical coupling between transducer 321 to transducer 322 and vice versa. Sounding absorbing materials is placed on the sides and bottom of the cabinet as shown in 341,342,320,350, so as to avoid the sound reflections from the cabinet walls and to eliminate cabinet resonance effects.

With this configuration, each transducer 321, 322 will provide diffused incident acoustic waves which will stimulate force bending waves in the screen 250. Ideally, each transducer will radiate acoustic waves upon the whole of the screen surface.

THEORETCAL UNDERPINNINGS

The advantageous structure herein disclosed was the product of experimentation and study. It is believed that the following discussion provides the theoretical basis for the beneficial results obtained with the instant structure. This discussion has been broken into two parts.

PART 1

I. Background

In contrast to the recent rapid progress of digital circuit wave processing engineering, most of the spatial audio sound wave engineering problems have been interpreted by classical acoustics. On the other hand, modern wave theory is advancing in optical science particularly quantum electronics.

Recently, more and more analogies are drawn between optical phenomena including optical wave theories and audio frequency phenomena. In particular, the concept of the phase conjugate wave is useful for analyzing audio interference phenomena. Holography and four-way mixing are now being examined in the context of audio. It has been found that articulating such problems is the first step to developing multi-dimensional stereophonic systems.

II. Introduction

Numerous attempts have been made to minimize the effects of interference in multi-speaker stereo, particularly by installing many microphones or by phase averaging. Presently, attention is focussed upon frequency and amplitude fidelity rather than reproduction of accurate phase. Over the decades, two speaker stereo systems have been accepted as de facto, even though two sound waves artificially represent a single sound source.

Accidentally, the author found the phenomenon that a specific screen placed in front of stereo speakers creates delicate changes of sound quality and dimensionality. Further investigation of such phenomena led to an understanding of the underpinning principle. The mechanism is the interference phenomena among many incoherent but phase conjugated waves which emerge from common wave sources at the studio. The interference phenomenon is nothing but the case of holography or four-way wave mixing. Heretofore, on two speaker systems the interference annoys the listener. Hence, today, sound improvement by decreasing the interference has been one focal point of stereo sound engineering. The applicant has found that such approaches are a dead end and produce no ideal solution. The only way to improve sound is to enhance the interferences and use them as the sound sources.

III. Features of Audio Sound Waves

Before we discuss the details, let us pay attention to several unique features of audio sound waves. These are:

- Music and voice sounds have a wide frequency and phase spectrum. They are often incoherent waves.
- Among the recorded sounds, many are conjugated i.e. sharing the same origins in the studio.

Those two features manifest as following:

- Steady standing wave interference patterns are mostly created among conjugated waves transmitted through left and right channels.
- A conjugate is required in order to form aural holographs. Coherency is not required.
- The listener's sensation of direction, which is the phase front propagation direction of the wave, does not necessarily coincide with the direction of real wave energy propagations. Difference can be 0~180 degrees.

IV Conjugate Waves

Conjugate waves are waves radiating from a single small area—comparable to or less than the size of a wave length. Such waves are also termed phase conjugates. For our purposes, phase conjugate broadly means related by phase and time to a single origin.

Radially propagating complex conjugated waves are taken as:

$$I\,(A\cdot wt)=\xi(A)\,exp\,[-i(\omega t-kA)]$$

where A is the position vector of observers refer to as the point wave source. K is the propagation constant, so to speak K vector.

The waves heading in the opposite direction are:

$$I\,(A\cdot wt)=\xi(A)\,exp\,[-i(\omega t+kA)]$$

These two waves are phase conjugated. There are numerous examples of such waves. Incident and reflected waves provide one example. Conjugate waves have many special properties which are now being explored. In the literature, a number of possibilities have been noted.

Please refer to Ref. for example, Optical Phase Conjugation (Theory and Application), Edited by Robert A. Fisher, 1983, Academic Press, Inc.

Quoting a few sentences from Ref., p. 19: "Optical phase conjugate is a fascinating subject, with great promise for application to image transmission—optical filtering—dispersion compensation—distortion compensation—image processing—high resolution microscopy, to name a few possibilities." We witness the above features on our sound screen.

From p. 25: "The first experiments in what we now call optical phase conjugation were performed by Gerritsen (1967) and Stacher and Amodie (1972). These researchers first introduced the concept of a grating produced in the medium owing to the interference of two light beams and the subsequent diffraction of the beams from their owning grating.

A. Phase Conjugated Waves and Audio Stereo Systems

How could the conjugate wave theory be implemented in audio frequency acoustics? We would like to start from the simplest possible case of two microphones and two speaker stereo. We have to keep in mind that phase conjugate depends on symmetry.

Figure 10:
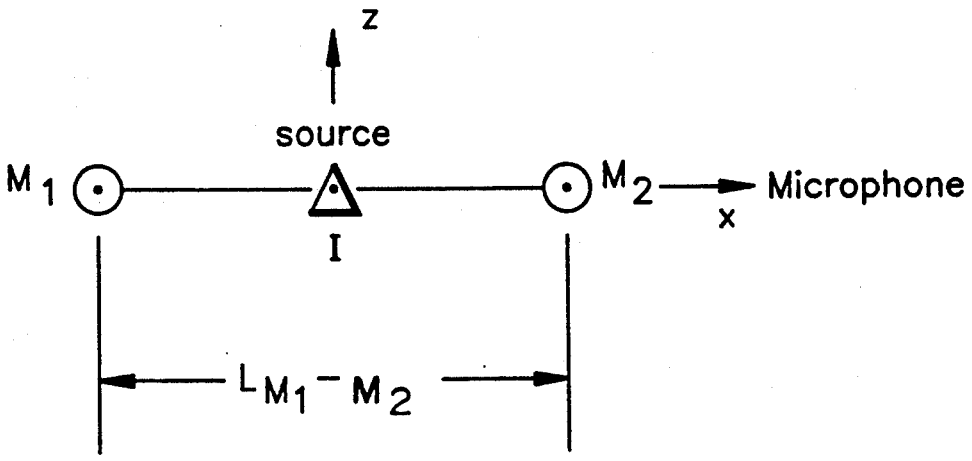
FIG. 10 illustrates a two microphone arrangement where the microphones and the sound source are located on a straight line.

FIG. 10 shows a two microphone arrangement where the microphones and the sound source are located on a straight line. The sounds reach the microphones from opposite directions.

To retain the phase conjugate over the entire system, we need to make left and right channel electronics symmetrical. It is necessary to make one channel 180 degrees out of phase with the other for the imaginary part and zero degrees out of phase, or in phase, for the real part. Left and right electronics are identical, but one of them has an additional phase shifter at the input or output circuit. Often a uniform and accurate phase shift in an electronics circuit over the entire audio frequency band is difficult to obtain; yet accurate phase shifting is necessary to achieve symmetry. Perhaps the best and simplest way of creating a 180 degree phase shift between two channels is to interchange the polarity of the wire at the left or right speaker terminal.

The symmetry of physical wiring in the electronic circuit has no consequence, because in the electronic circuit the sound propagates with light velocity, which is about a million times faster than that of sound in the air.

B. Phase Conjugate and System Symmetry

Figure 11:
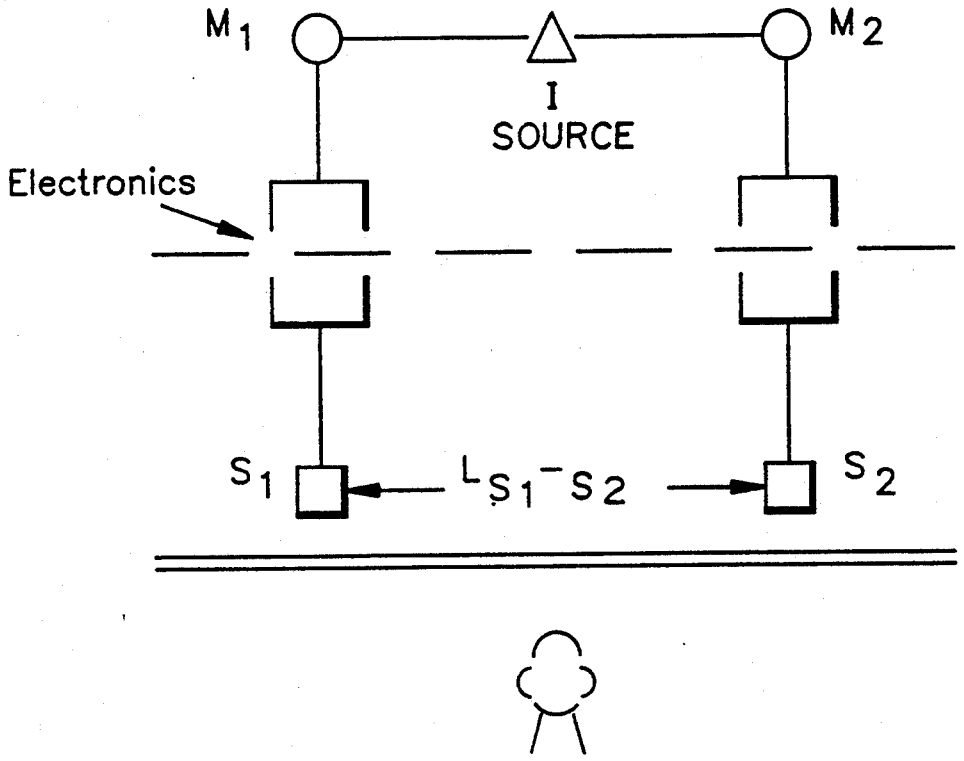
FIG. 11 illustrates diagramatically a phase conjugate holographic sound screen stereo system.

The effect of phase conjugated audio in a two speaker system is diagrammed in FIG. 11. Ideal stereo systems reproduce acoustic, ambient sounds in the listening room which are identical to the recording/broadcasting studio. For ideal listening, two speakers are separated by the same distance as the two microphones to simulate the acoustic space around the microphones. If the microphones are facing each other, then speakers should face each other as well, as shown in FIG. 11. The space in between the two speakers will have oppositely signed phase conjugated waves. Such waves approach from opposite directions and create no moving steady standing waves. But we have to realize that standing waves in the air, which is a linear media, do not perform any sound conversion.

V. Sound Screen

In FIG. 11, we recognize that to fulfill the symmetry requirement on sound patterns between the recording studio and the listening room, we ought to have a media which brings two sounds together into one sound in front of the speakers. We can do it using a non-linear medium. Often in optics and microwave fields, first and second waves are mixed within non-linear media to create a third wave. Here we bring in a thin elastic sheet as the non-linear element in front of the speakers. The vertical bending vibration characteristic of such a sheet is non-linear. Let us call this sheet a "sound screen."

A. Excitation of Vertical Vibration

The mechanism of exciting vertical non-linear vibration on a screen is described in F. Fahy, Reference 5, pages 23 and 126.

The sound screen is a screen made out of elastic material which converts most of the impinging waves with various angles and time delay to forced bending waves. The holographic sound waves are made within a screen with this mechanism. This local vertically forced bending vibration displaces the air immediately next to a screen, and, as a result, generate the sound from the screen. Since vertical screen vibration is a non-linear phenomena, harmonic vibrations will occur. This feature enhances the high frequency sound reproduction and improves the tonality of musical instrumentation and voice. Indeed, often high frequency overtones are clearly heard from the screen.

B. Holograph

The standing waves on a screen are nothing but a Bragg interference pattern in one sense.

Please refer to Ref (4) Comparison of Holography with Four-Wave Mixing, p. 48.

It is well known that Bragg patterns manifest the characteristic location of a light source and the objects the light is reflected from. In microwave radars signal analysis is used to unveil the figure of objects by Fourier analysis of Bragg pattern. "Fourier Spectrum" is another, perhaps, more familiar term to some readers. Often this spectrum is termed a "Holograph," or "Four-Wave Mixing (FWM)." But Four-Wave and Holograph[4] have different connotations for an audio conjugated wave, as described in the following.

Left and right channel waves function'as both pumping and information carrying waves of the same frequency and the holographs themselves generate the radiation with a frequency equal to that of pumping audio sound. Furthermore, output waves turn into pumping waves.

One can expect that the sound we hear from a holographic screen will be quite close to the original sound source if the requirements for making phase conjugate waves, such as physical and wave symmetric arrangements, are met. The uniqueness of our system is that in a listening room a point sound source at the studio will be heard from a simulated grating sound source which represents a point source.

An important feature of the conjugate wave stereo system is the position resolution. Once we can reproduce the sound with high position and image resolution, we hear distinction between each musical instrument and voice. Experimentally, we found that the increase of sound image resolution is directly linked to upgrade of the tone quality of the reproduced sound. Smaller dimensions for the sound source and higher frequencies of sound does significantly increase resolutions.

C. Aperture and Screen Size

Going back to the analogy with optics, we said that the separation between two microphones is a key factor to increase sound resolution. It is the same in optics; large diameter objective lenses of low f number will have high resolution and depth perception. If you have many musical instruments, such as in an orchestra, a wide separation of microphones is preferred. If there are only a few instruments on stage, as for a solo or chamber music, only a short distance is required between them. In addition, the larger the screen widths allow a large number of grating lines, which provides higher resolution of sound image and better depth perception.

Please refer to Ref(7) Equivalent-Lens Theory of Holographic Imagining. J. Opt. Soc. Am. 38, 1084 by W. Lukosz (1968) .

On the sound screen shown in FIG. 11, phase conjugated waves of left and right channels approach each other from opposite directions. When waves superimpose in phase, standing waves will be built up to twice the original waves amplitude. Such standing wave image of the sound is fixed in position sensation, regardless of the location of the listeners. Also, image sound intensity distribution at any location of listeners in front of the screen is almost uniform.

VI. Experimental Holographic Stereo System

Figure 12:
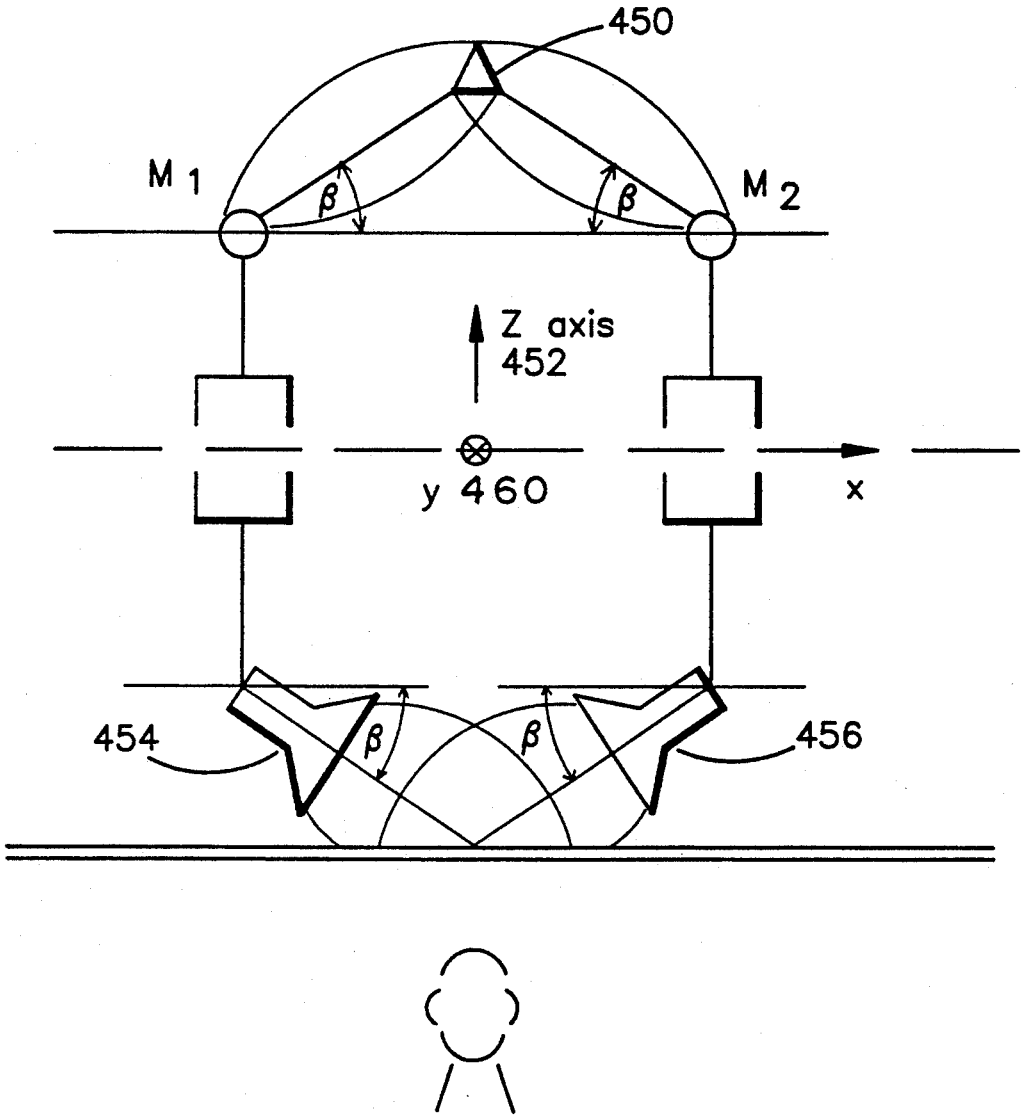
FIG. 12 illustrates vectorial relationships for elements of the phase conjugate wave holographic stereo system of FIG. 11.
Figure 13:
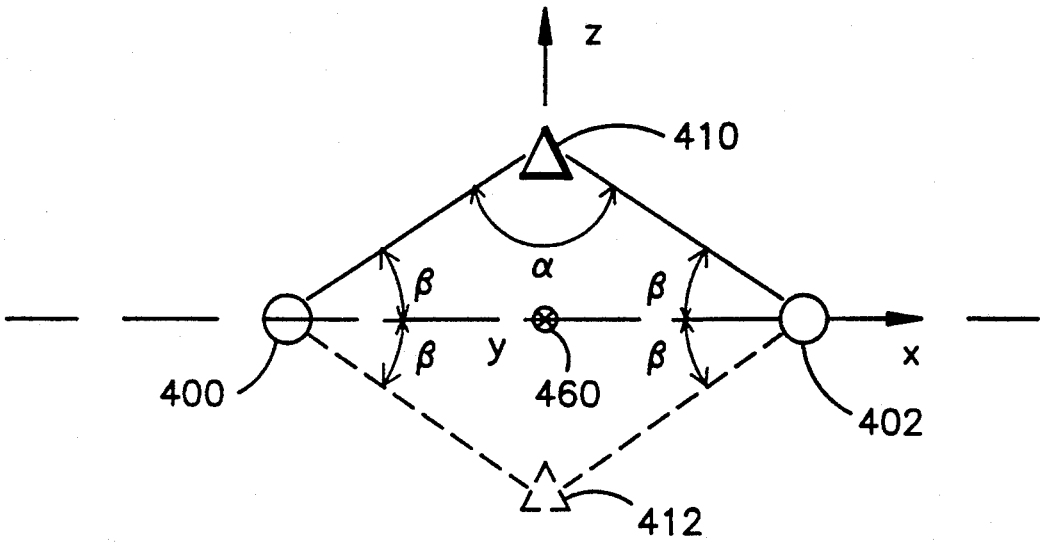
FIG. 13 and 14 illustrate the sound vector configuration for sound at a microphone.
Figure 14:
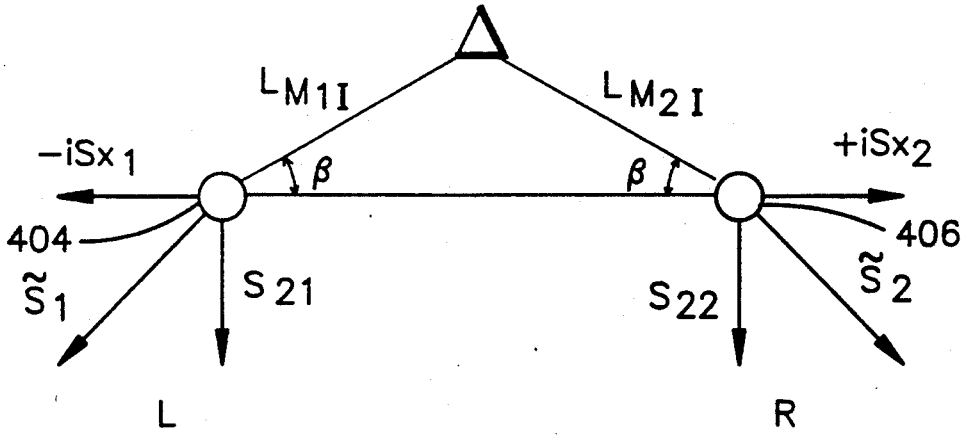

The detailed structure of the system is described above. FIG. 11 shows the principle of the phase conjugate wave holographic system. Our system is shown in FIG. 12. FIGS. 13 and 14 show the sound vector configuration for sound at the microphone. FIG. 12 shows both the microphone and speaker placed with angle $\beta$ relative to the X axis. The speaker arrangement emulates the microphone arrangement.

The angle $\beta$ is important for the creation of two dimensional images as we will describe later. Complex conjugate sound vector $S_1$ and $S_2$ becomes identical with FIG. 10 where $S_1$ and $S_2$ are pure imaginary and opposite sign at $Z=0$, $X=0$.

In FIG. 14, as real components $S_{z1}$ and $S_{z2}$ start to increase, phase conjugate characteristics gradually disappear as angle $\beta$ increases and reaches to zero at 90 degrees. We should note that our artificial polarity switch of $S_1$ and $S_2$ has only limited meaning when angle $\beta$ is small. The definition of the grating on the screen decreases proportionally to the distance of sound Source I from line $M_1$—$M_2$ and is also proportional to the decrease of definition of the sound source. This is particularly significant at higher frequencies. Therefore, it is preferable to place high frequency sources, such as violin, voice, piano and others, close to the line $M_1$—$M_2$.

At the lower frequency, the situation is quite different. The distance measured in terms of a few wavelengths becomes long enough to cover the area where musical instruments and voices are located.

A. Experimental Results

Our experimental unit appears to support the validity of our interpretations. For example:

1. Walking in front of a screen, there is least movement of sound image and variation of sound intensity. No interference effect is recognized by listeners at any location. This characteristic is particularly clear when two dominating microphones were used for recording. Studio microphone arrangements can be predicted from aural image behavior. This illustrates the holographic properties of the screen.

2. Listeners have the sensation that the sound sources are located outside of the sound screen up to 180° degrees of from the center line, even though there is no reflection from the side walls of the room. This illustrates the properties of four wave mixing.

3. The closer listeners move toward the screen, the clearer they hear sound source position definition and separation on the sound image. Also the sound quality improves at closer positions. This illustrates the holographic character of the sound screen.

4. Listeners feel that there is a variation of sound view angle and sound quality which varies with distance from the screen. When positioned closer, the listener will perceive wider angle and when further, the narrow angle, just as we experience the difference between good orchestra seats and balcony seats. This also illustrates the holographic character of the sound screen.

5. There is a clear relationship between position and time resolution. Clear sounds are heard with good position definitions. The effect is significant on transient sounds such as consonant of the voice and percussion sounds which have overtones. In general, the details of sounds and voice inflection become clearly recognizable. This demonstrates holographic effect.

6. The echo effect becomes clearer and there is enhanced perception of space around the performers. Often one can sense the travelling of the sound on stage on a horizontal direction. The holographic effect is the main cause.

7. Abrupt motions on the stage are felt on the body rather than heard. This is independent from the frequency character. It is the characteristic of phase conjugated waves.

8. There are clear overtones of voice and instrument sounds with position definition due to non-linear screen vibration.

9. Insertion of a 180° phase shifter converge the sound image toward the screen center area. At the same time sound quality deteriorates. This illustrates the differences between grating and non-grating sources.

10. A large sound amplitude dynamic range is derived from spreading grating sound sources over the entire screen area.

11. Noise levels are extremely low on LP and CD. This is very effective for all kinds of noises except some FM receiver and tape noise and large scratches on LP. This demonstrates the filtering characteristics of four wave mixing.

These qualitative results were gathered from the author's experimental unit and seem consistent with the theoretical interpretations presented here.

B. Problems on Recorded Media

Major problems faced during the experiment were the unknown factors of the recording process, particularly studio configurations; number of microphones and microphone directionality; the distance between microphones; phase delay and polarity characteristics of the mixer. However, it was observed that overall improvements of sound have been remarkably good on all of the recorded media; only the degree of improvement varied. Improvement of some old recordings (1955 and later) with the holographic system are remarkable. This may be due to the fact that in making those recordings, often only two microphones were used.

VII. System Symmetry and Dimensions

The recording and reproduction of phase conjugate sound waves require various system and component symmetry.

Please refer to FIGS. 13 and 14. The microphones 400 and 402 are point sinks from the wave theory standpoint. 400 and 402 are symmetrical about the Z-axis; therefore, vector 404 is identical to 406. Exchanging 400 and 402 does not cause any difference in the electronic signal for playback. Microphones 400 and 402 in FIG. 13 are therefore not capable of providing aural clues to whether the sound source is located at position 410 or mirror image position 412. A listener cannot tell if the sound is coming to the microphone from the front or behind. The front and back information have been lost.

The applicant found that it is possible to create the $2\pi$ two dimensional and a true $4\pi$ solid angle three dimensional stereo system.

In FIG. 12, the microphone and speaker both ideally have identical directional characteristics. The transducer simulates the field around the microphone only by combining it with the sound screen.

There is a difference in performance between the system of FIG. 12 compared and the system having a non-directional microphone Assuming that sound source 450 is on the line of Z-axis 452. Speaker 454 is equal to Speaker 456 as are vectors 404 and 406 in FIGS. 13 and 14, but the proportional intensity of 404 and 406 does change from position 410 to position 412, due to asymmetry of the sensitivity curve for microphones 400 and 402 around the Y-axis 460. The system lacks an absolute mirror image discrimination capability.

VIII. Two Dimensional Dipole System

Figure 15:
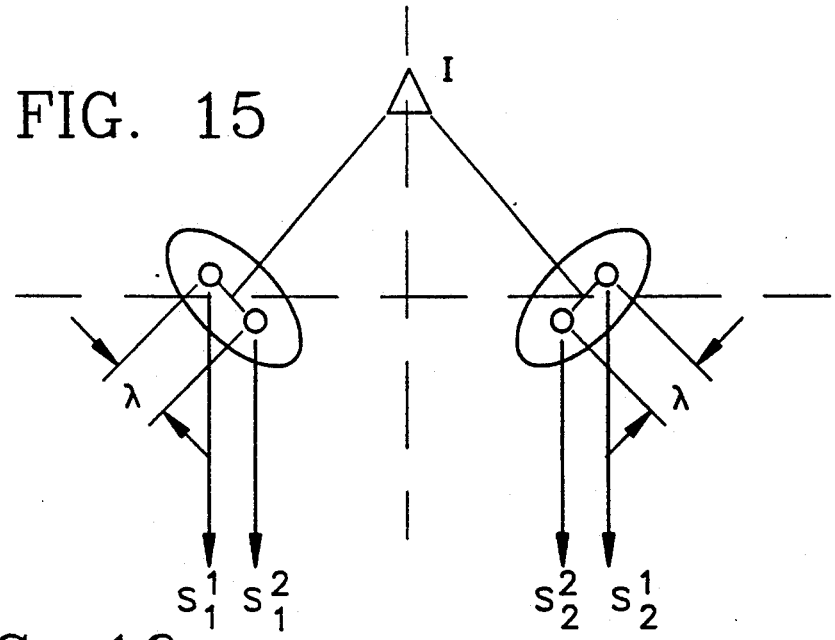
FIG. 15 illustrates a lay-out for a 2 point microphone system.

A direction sensitive microphone system will improve the spatial sensation for background sounds. Further enhancement of spatial sensation is possible if two point microphones are used with two point speakers. A two point microphone will convert two dimensional vector sound waves to vector electronic waves so that vector conjugate characteristics will be maintained throughout the electronic circuitry. The layout of the two point microphone set-up is shown in FIG. 15.

Figure 16:
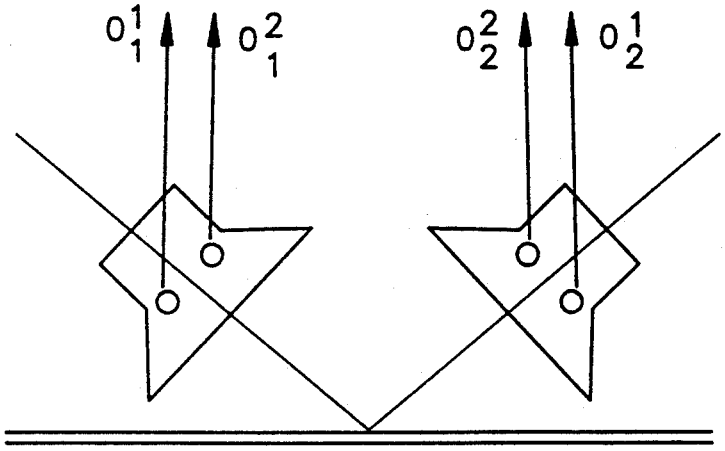
FIG. 16 illustrates a lay-out for a 2 point transducer or loudspeaker system.

To emulate the two point microphone system we must have a two point transducer system (shown in FIG. 16). The total system requires two main left and right channels and two subchannels for each as shown in FIG. 16. Such a system is capable of reproducing a total $2\pi$ plane angle coverage. In addition, the ambiguity of depth definition will be eliminated.

IX. Three Dimensional Three Point System

Figure 17:
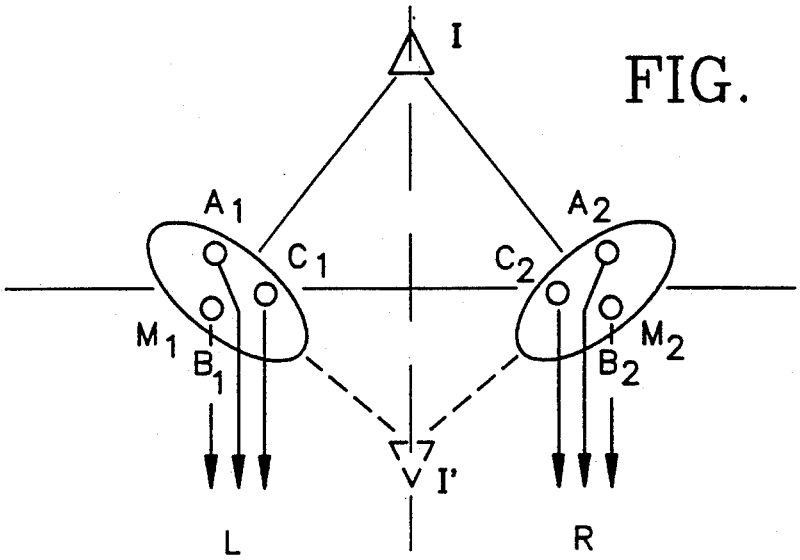
FIG. 17 shows a lay-out for a 3 point microphone system.

Likewise, we can extend the stereophonic sensation from two to three dimensions. FIG. 17 shows the layout of three point microphone M1,M2 720,730 set-up. The sound screen used against two, three point transducers for this system must be large enough to exhibit aural position sensation along X and Y directions. Each left and right channel 740 and 750 will consist of three subchannels as shown in FIG. 17. Each $M_1$ and $M_2$ left and right channel microphone consists of sound sensors $A_1$, $B_1$, $C_1$ and $A_2$, $B_2$, $C_2$. The separations between those elements are arranged such that $A_1B_1 = A_2B_2$, $B_1C_1 = B_2C_2$ and $C_1A_1 = C_2A_2$- Microphones $M_1$720 is positioned against $M_2$ 730 in mirror image relationship to a plane including Z-axis 760 and y-axis 770 as shown in FIG. 17.

In addition, axes 780 and 790 are perpendicular to the planes which include $A_1$, $B_1$, $C_1$ and $A_2$, $B_2$, $C_2$, respectively. Such axes 780 and 790 are also arranged in mirror symmetry to each other relative to z-y plane. Keeping the angle larger than zero but smaller than 90 degrees relative to z axes 770, 760, solid angle $\Phi$. On the reproduction side, the same transducer arrangement has to be made. These element transducers for left and right channels must be placed with the angle described on recording microphone arrangement relative to the vertical axis of a sound screen. Two three-point microphone systems and transducer systems will be sufficient to reproduce the three dimensional sound in space.

X. Holographic System With More Than Two Microphones

The system which consists of more than two microphone arrangements is matched with equal numbers of transducers. Multiple microphone and transducer systems may become viable for some applications such as a big theater or outdoor system, but the physical constraints for exciting a sound screen is the same as that for two transducer systems. XI. Conclusion The data compiled from the past three-year experiments with the author's prototype appear to be sufficient to identify underpinning principles of the system. Numerical information, particularly on acousto-mechanical behavior the sound screen, is necessary for further development of the system and the improvement of system performance.

PART 2

Additional Theoretical Considerations

The following is believed to provide additional theoretical explanation of the beneficial results of the instant structure.

I. Introduction

Acoustic holography has been developed in the fields of optical communication and data processing(1), medical(2) and mechanical testing(3). Those holographs are either acoustical or mechanical origin but the images are examined optically, mostly by monochromatic and coherent light beams.

It has been experimentally determined that acoustic holography can be used to enhance audio performance. An experimental model has a horizontally extended wide screen which covers the front opening of a cabinet. The sound images of the sound sources on the stage are simulated by a two dimensional holograph on the sound screen. Conjugate wave Four Wave Mixing (FWM) provides a theoretical foundation for analysis of the sound screen structure.

True two and three dimensional sound systems could be built if the system and its components are made to comply with phase conjugate FWM theory.

The requirements for such systems are:

A sound screen which integrates left and right channel speaker sounds into one united stereophonic sound of which images spill over from the screen surface.

A system which is acoustically symmetrical, as described above, from recording studio to listening room.

A sound screen made of specific material, under tension, and configured to absorb the sound as forced bending waves and then to re-radiate the sound with high efficiency.

II. System Schematics

A. Stationary State

For the purpose of system analysis, the following assumptions are made.

The microphones and transducers are direction sensitive.

There are only two microphones in the studio and the separation between left and right microphones is equal to that of left and right transducer or loudspeakers drivers.

The left and right channel electronic circuits are acoustically symmetric (not identical) in both phase, amplification and frequency characteristics.

Figure 18:
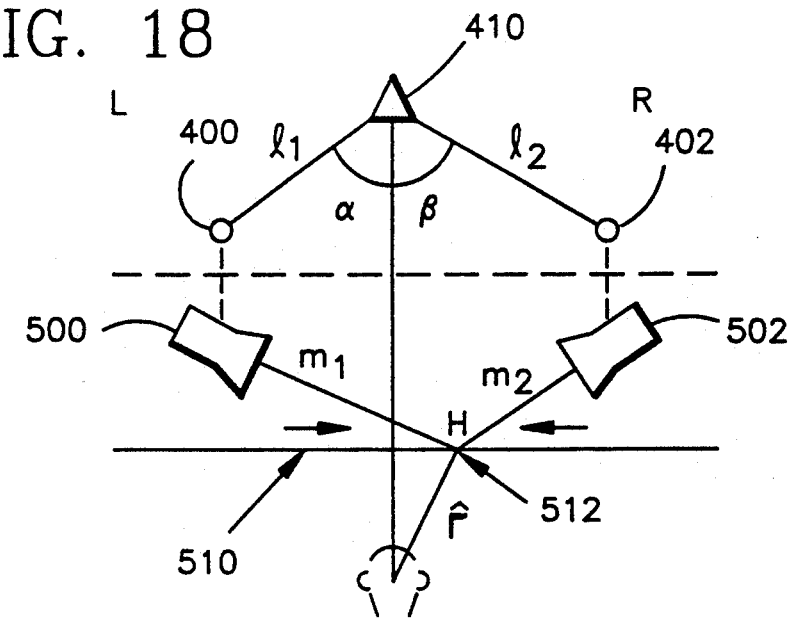
FIG. 18 is a diagrammatic illustration of the sound screen conjugate wave system of the present invention.

FIG. 18 is a schematic diagram of sound screen conjugate wave system. 410 is the point sound source. The waves radiating from 410 reach microphones 400 and 402 with some phase delay and time lag between them. The electronic signals from 400 and 402 are transmitted to left and right drivers 500,502 with light velocity. Therefore, the distance between a microphone 400 or 402 and the corresponding driver 500 or 502 is negligible. The counter propagating left and right channel sounds on a sound screen 510 create the interference pattern which is a holograph of sound source itself. The listeners in front of Screen 510 perceive the sound image produced by the holograph which simulate sound source 410.

III. Interference Pattern

The sound waves at point H(r) 512 on the sound screen 510 are described by the counter propagating conjugate waves originated from drivers 500,502 as $$P_1(r) = \frac{S_1}{m_1} \int\int a_z \exp\left(\frac{2\pi i}{\lambda} m_1\right) dA, \tag{1}$$

$$P_2(r) = \frac{S_2}{m_2} \int\int a_z \exp\left(\frac{2\pi i}{\lambda} m_2\right) dA.$$

Where az is a unit real vector of the sound screen. The electronic sound waves from microphones 400 and 402, $M_1$and $M_2$, are amplified with gain G and input to the transducers 500 and 502 as $G \cdot M_1$ and $G \cdot M2$ .

Microphone signals $M_1$ and $M_2$, which come from source 410, then can be derived from vectors I1 and $I_2$ which are taken along lines $l_1$ and ;$_2$ from source 410 as shown in FIG. 18.

$$M_1 = \frac{I_1}{l_1} \exp\left(\frac{2\pi}{\lambda} i l_1\right), \tag{2}$$

$$M_2 = \frac{I_2}{l_2} \exp\left(\frac{2\pi}{\lambda} i l_2\right).$$

where $$I_1 = I exp\,(-i\alpha),$$

$$I_2 = I exp\,(+i\beta). \tag{3}$$

The sound intensity at point 512 of Screen 510 is calculated from the product of linearly superimposed conjugate waves:

$$\begin{aligned} \theta(r) &= \frac{1}{2}(P_1 + P_2)(P_1 + P_2)^* \\ &= \frac{1}{2}(|P_1|^2 + |P_2|^2 + P_1P_2^* + P_1^*P_2) \end{aligned} \tag{4}$$

Combining Eq. 1,2,3 and 4, we have:

$$P_1(r) = \frac{GI}{m_1 l_1} \int\int \exp i\left[\frac{2\pi}{\lambda}(m_1 + l_1) - \alpha\right] dA. \tag{5}$$

-continued $$P_2(r) = \frac{GI}{m_2 l_2} \int\int \exp i \left[ \frac{2\pi}{\lambda} (m_2 + l_2) + \beta \right] dA$$

to calculate $\theta$ (r) we have to take into account the wave configuration surrounding the driver 500,502 and the screen 510.

B. Temporal Transient State

Figure 19:
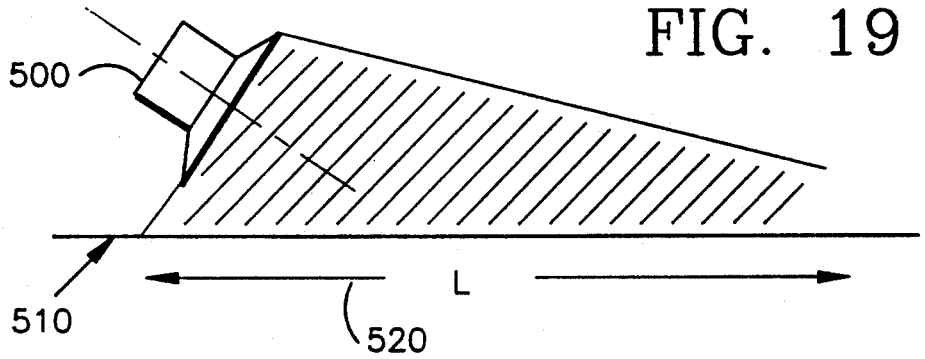
FIG. 19 illustrates the sound wave propagation pattern from a transducer onto a sound screen surface.

FIG. 19 shows the sound wave propagation pattern near by a driver and a screen. It shows:

The near field pattern of driver 500 (or 502) is complicated. The sound wave radiates from various locations on the cone, so that sound waves from the driver 500 are diffused.

The distances between the sound originating points on the cone of driver 500 and the screen surface 510 varies from about 8 inches to 5 feet. This creates the variation of sound arrival times to the screen.

From above points of view we define the time domain $\tau$ and the space domain L, 520, of the conjugator. This means that there are many possible time and location combinations for forming interference standing wave patterns- Maximum value of L, 520, is equal to the width of a screen 510 where $\tau$ is equal to the travelling time of bending wave over L. Our experimental speaker has L =2.5 m and $\tau$=5-10 ms, where $\tau$ decreases with higher frequencies and varies with screen materials. Also, $\tau$−L/Cph, where Cph is the phase velocity of bending wave.

The phase velocity Cph is calculated as follows:

$$C_{ph} = \left( \omega^3 \frac{D}{\rho} \right)^{\frac{1}{5}} \text{ for fluid load} \quad (6)$$

$$C_{ph} = \omega^{\frac{1}{2}} \left( \frac{D}{m} \right)^{\frac{1}{4}} \text{ for air interface} \quad (7)$$

where: m is the mass per unit length of plate, is the mean fluid density and D is the bending stiffness of the plate.

In our case one side of the screen is facing to an air tight cabinet so that an acoustic damping effect is anticipated, particularly in lower frequency ranges. Cph for our case would be in between the values of Eq(6) and (7).

Within $\tau$ and L domain, the conjugation of $P_1$ (r) and $P_2$ (r) to produce new conjugate waves take place on the surface of the non-linear sound screen 510 and the temporal convolution occurs. Optical applications of temporal convolutions are found in R. Fisher p. 80, 94, 559, 575 also on H. Stark Ref(6) p.156.

The sound energy on the screen over the time period $\tau$ is $$\epsilon(r) = \tau\theta(r) \quad (8)$$

On our experiment it was found that the transmission loss of the $P_1$(r) and $P_2$(r) sound through screen is about 3db and does decrease as power increases.

Putting this relation in general form, of transmittance T we obtain:

$$T = f(\epsilon) < 1 \quad (9)$$

The bending vibration mode of a thin screen is symmetric relative to plane x-y. This implies that the sound radiation to the free space of both sides of the screen is also symmetric. In our case, most of the impinging waves are absorbed by the screen. Then they are converted equally to the bending reflecting wave energy Er and forward wave energy Ef. This situation is unique in our case and not being observed on optical FWM or holograph where non-linear materials are much thicker than the optical wave length and material absorption and phase shift are significant. This explains that the 3db loss corresponds to the reflecting waves toward to the cabinet. However the air tight cabinet does change the symmetry and acoustic impedance of the screen, resulting in the increase of T particularly at the lower frequency range.

IV. Degenerate Four Wave Mixing DFWM

The thin screen is particularly a suitable for a forward configuration of the Degenerate Four Wave Mixing (DFWM) scheme. See R. Fisher p. 310. Such screen is highly absorbable and it converts the absorbed energy to the sound radiations $\epsilon$f and $\epsilon$r with high efficiency. Accordingly, sufficient pumping power for both positive time and reversed time propagating waves are available. The situation is ideal for x-z plane 360 degree stereophonic systems.

Carrying on the calculation: From Eq 4, 8, and 9

$$\begin{aligned} \epsilon &= \epsilon_o - \epsilon', \\ \epsilon &= \epsilon_o - \frac{\tau T}{2} (P_1 P_2^* + P_1^* P_2), \\ \epsilon_o &= |P_1|^2 + |P_2|^2. \end{aligned} \quad (10)$$

Where $\epsilon$o is the non-interfering waves energy of P1 and P2.

Inserting Eq(5) to (10) we have: $\epsilon$o waves are heavily damping forced traveling waves and decay out within a short distance. The energy density at point H on the screen is $$\begin{aligned} \epsilon &= \epsilon_o - \tau T G^2 \left\{ \frac{I_1 I_2^*}{m_1 m_2 l_1 l_2} \exp\left[ \frac{2\pi i}{\lambda} (m_1 + l_1 - m_2 + l_2 \right] + \right. \\ &\quad \left. \frac{I_1^* I_2}{m_1 m_2 l_1 l_2} \exp\left[ \frac{2\pi i}{\lambda} (m_2 + l_2 - m_1 + l_1) \right] \right\} \\ &= \epsilon_o - \tau T G^2 \frac{2I^2}{m_1 m_2 l_1 l_2} \cos \frac{2\pi}{\lambda} \{(m_1 + l_1 - m_2 + l_2) + (\alpha + \beta)\} \end{aligned} \quad (11)$$

Eq(11) shows that we have a stationary standing wave or grating for which the maximum to minimum separations are only a function of the sound pass length difference between left and right channels and the wave length. This interference pattern does exist regardless of angle $\alpha$ and $\beta$.

Eq(11), however, presents only a macroscopic view. For further understanding the interaction between the sound waves and the screen vibration must be discussed. The extension of Eq(11) using the bending wave equation are presented in section VIII, below.

A very similar situation is found on optical data processing where counterpropagating high frequency acoustic waves are being used for Surface Acoustic Wave (SAW) acousto-optical devices. An example is taken from H. Stark p. 308 in FIG. 20, his FIG. 7.3-1.

Figure 20:
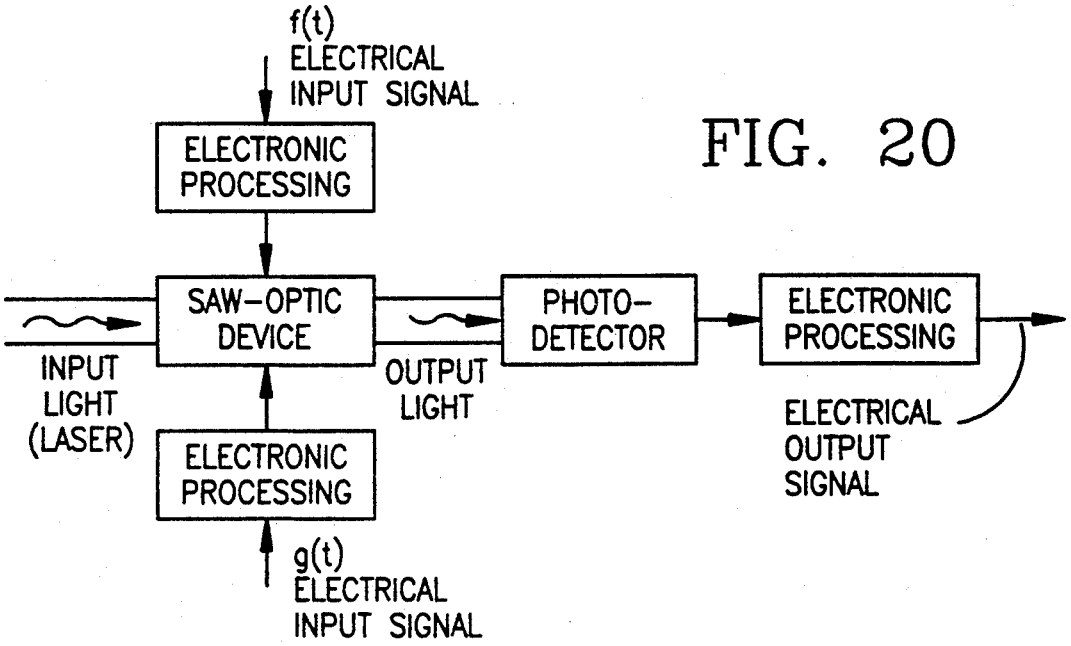
FIG. 20 illustrates a typical surface acoustical optical signal processor.

Many papers have been published on this subject. Several overview articles are found in the H. Stark reference. The objective of the SAW optic signal processor of FIG. 20 is to display either stationary or nonstationary optical images via electrical signals. Applying Eq(7.3-11) of H. Stark in this case, we have $\omega$ as angular frequency of an audio wave. This equation is equivalent to Eq(12) of R. Fisher at p. 576. There, the concepts such as time reversal and wave conjugation, wave vector matching and convolution are described.

V. The System With Single Point Microphone

The non-directional single point microphone has been extensively used for recording and broadcasting. We would like to analyze the single point microphone system. Using an example on the $\alpha+\beta=0$ and near 180 degree cases for comparison, we see that the difference between those two cases is found in the schematics of FIGS. 21 and 22, which show the differences of wave characteristics between those two cases.

Case (a): If the electronics attached to $M_1$ and $M_2$ from FIG. 21 are 180 degree out of phase, then the sign of imaginary part x of complex conjugate $Z-iX$, $Z+iX$ will be preserved up to the left and the right drivers, S1, $S_2$. Then the drivers will be excited by conjugate waves.

The scalar output from point microphones $M_1$ and $M_2$ do not have any direction information of left and right. Therefore, those scalar output signals must be tagged by adding a+ or −sign for the right or left channel. This is an approximation of a vector and is valid only when $\alpha+\beta$ is near 180 degrees as you can see from FIG. 21.

When $\alpha+\beta$ is 180 degree we have an ideal one dimensional stereo sound image on a screen with some depth sensation of the space which comes from the lags of arrival time to microphones $M_1$ and $M_2$. It is recognized that time lags are more clearly observable with the sound screen than with conventional stereo, since the sound screen gives higher position definition of sound sources along the x-axis.

Case (b): As shown in FIG. 22, the vector 11 and 12 overlap and the distinction between $M_1$ and $M_2$ is lost because the distances $M1-S_2$ and $M2-S_2$ are acoustically zero. Only the difference $M_1$ and $M_2$ could be sensed the distance by arrival time from I, but with no direction definition. This is equivalent to a situation where the sound at $S_1$ and $S_2$ is coming from only one microphone M2 (or M1). Therefore, in effect this is monophonic system. It was observed that the entire sound screen functions as one speaker cone and all sounds merge together to the center part of the screen. In such cases, Eq(11) dictates that standing wave patterns on the screen shift only $2N/\lambda\cdot\beta/2$ no matter what the distance differences (ml +11)−(m2 +12) vary about.

Importantly the $2N/\lambda/\cdot\beta 2$ movement of a standing wave pattern along the x axis does not shift the holographic image. This is because, on the holograph, the position of the sound source image corresponds to the diffraction angle of the source image and not to the position of holograph.

In R. Fisher, p. 51, it was found that the expression of FIG. 22 was as follows:

"P1. P2 term involves the scalar product of pump waves. The grating formed by two pump waves is not equivalent to a spatial interference pattern which is formed is a temporally modulated grating stationary in space."

VI. Four Wave Mixing FWM

First, please refer to optical FWM and Digenerative FWM (DFWM) shown in R. Fisher p. 50.

The sound screen waves are designated as analogous to the optical examples.

Conjugated P1 and $P_2$ was from left and right drivers impinge upon the screen. The grating result from interference between $P_1$ and $P_2$ conjugated waves will determine the direction of forward wave $E_{f1}$ and $E_{f2}$. This is the situation we referred in previous section.

The situation shown in FIG. 24 occurs as a result of FIG. 23 but simultaneously.

In FIG. 23 $P_1$ and $P_2$ play two roles, pumping and proving; this is DFWM. Turning now to FIG. 24, the $\epsilon_{f1}$ ($\epsilon_{f2}$) wave pairs with the reflected $P_2(P_1)$ wave, i.e. $P_{2r}(P_{1r})$ and thereby creates the grating as shown in FIG. 24, perpendicular to the first grating. Then, $p_2(P_1)$ acts as the "prove" wave and produces a backwards time reversal propagating wave $\epsilon_{b1}(\epsilon_{b2})$.

This time reversal backward propagation makes it possible for us to feel that sound is coming to you from behind even though waves are only coming from the screen in front of you. The wave energy propagation and the propagation of the wave phase front are two different things.

Two gratings mentioned above are instantaneously and simultaneously created and are superimposed. The dominating factor of creating the forward wave $E_f$ and the backward wave $E_b$ is the K vector momentum conservation law, which is discussed below.

VII. K Vector Relation

Figure 26A:
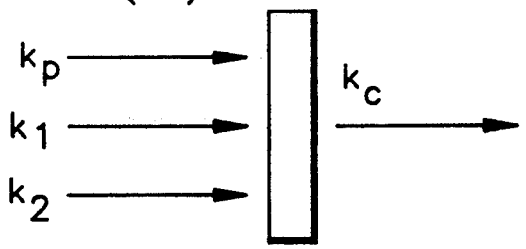
Figure 26B:
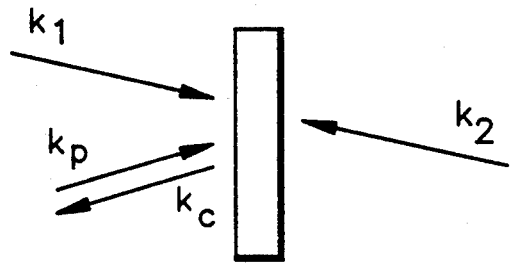
Figure 27A:
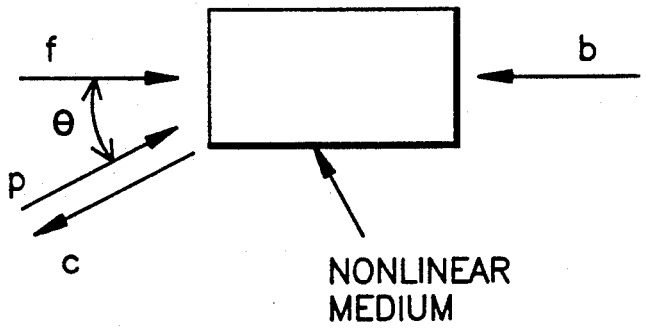
Figure 27B:
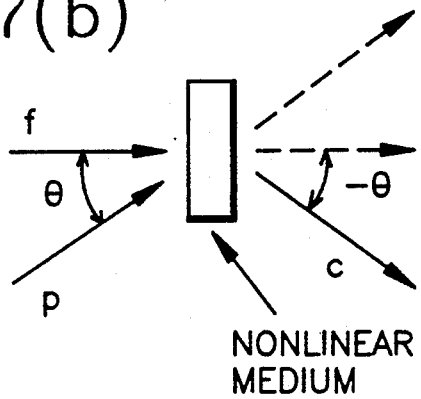

The conservation of the sound wave momentum is the important fact which controls the FWM, DFWM scheme and tell us whether it is feasible or not. See R. Fisher p. 53, 310. Also, see FIGS. 25–27.

Figure 25:
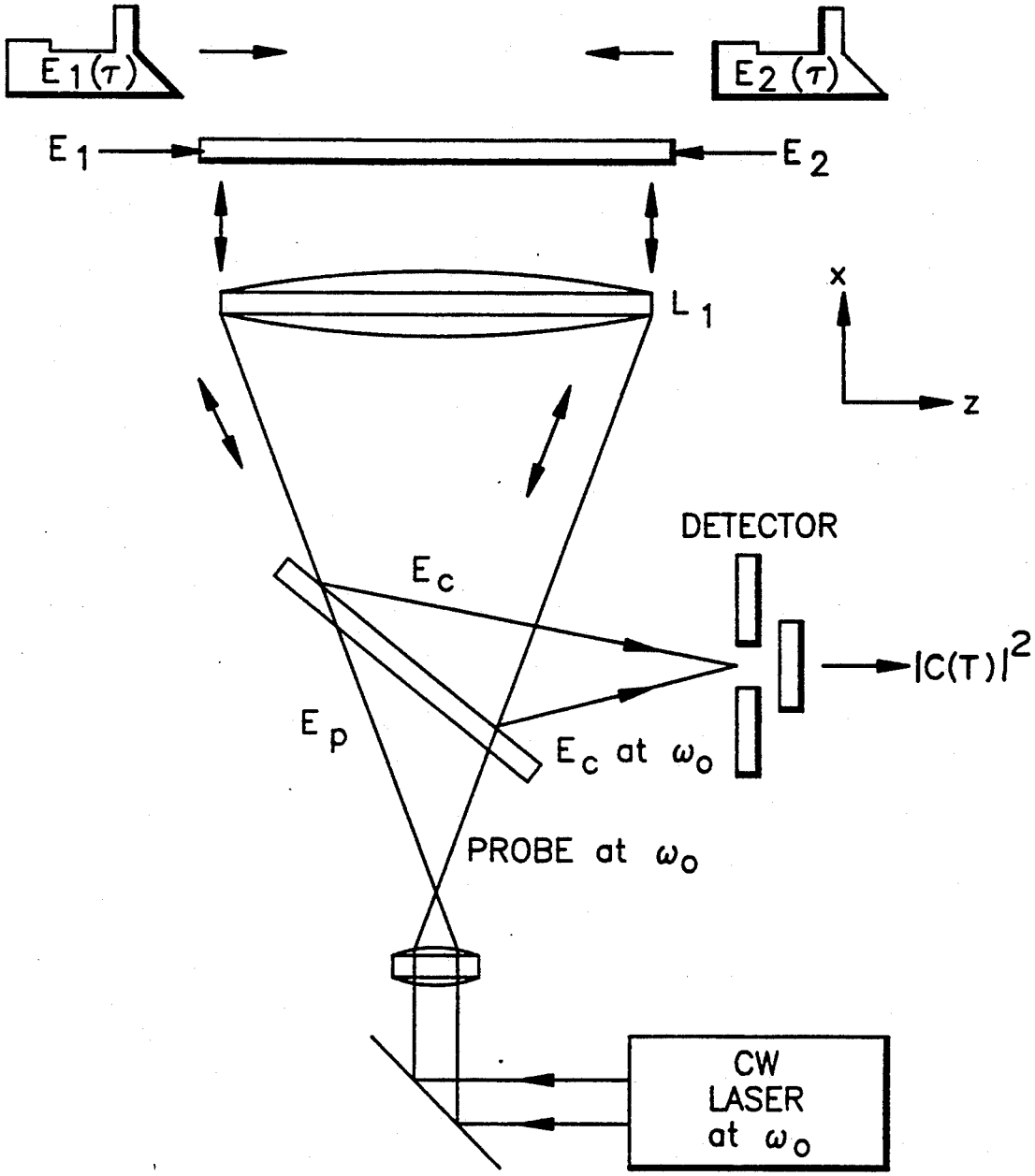
FIGS. 25, 26 and 27, illustrate typical temporal convolution and correlation phenomena.

Referring now to FIG. 25 which shows temporal convolution and correlation.

The envelopes of two counterpropagating fields $E_1$ and $E_2$ can be convolved or correlated (O'Meara and Yariv, 1982) using the orthogonal pumping geometry shown in FIG. 25. A third input field $E_P$, uniform in Z and essentially cw, enters through the side of the delay line normal to the propagation direction of $E_{1,2}$. Where the three fields overlap, a backward-going wave $E_c$ is generated. If $E_c$ is collected with a lens, the amplitude at the focus would have the basic form of a convolution integral, $$E_c(0.1)\alpha Y E_1(z\text{-}vi)E_2(z+vi)\ dz. \quad (12)$$

Here, FIG. 25 shows the four-wave mixes as a time domain correlator. The modulation envelopes $_{\Delta 1}(z)$ and $_{\Delta 2}(z)$ are cross correlated in the nonlinear slab as they pass each other. The detector output gives the correlation function as a function of time. (After O'Meara and Yariv, 1982.)

Turning now to FIGS. 26(a) and 26(b) and 27(a) and 27(b), they show a schematic illustration of the two common configurations for the DFWM interaction, involving two combinations of four waves f, p, b, c, whose frequencies are equal $\omega f = \omega p = \omega b = \omega$ and $\omega c = \omega f + \omega b - \omega p = \omega$ where f is the forward pump wave, b the backward pump wave, p the probe wave, and c the conjugate signal wave. (a) The backward configuration with $\theta << 1$, is the principal DFWM interaction considered here. (b) The forward configuration is used principally for highly absorbing thin samples. In the nomenclature of four-wave mixing, the forward pump beam constitutes two input waves and the probe the third input wave.

For the present system, as shown in FIGS. 23 and 24, K vector representations for case (a) and (b) are:

case (a)

$K_1$ and $K_2$ pumping, $K_{r2}$ proving and $K_{f1}$ conjugate wave vector $$K_{f1} = K_1 + K_2 - K_{r2} \tag{13}$$

case (b)

$K_{f1}$ and $K_{r2}$ pumping, $K_2$ pumping, $K_2$ proving and $K_{b1}$ conjugate wave $$K_{b1} = K_1 - K_{r2} + K_2 \tag{14}$$

This relationship is one of the many very unique features of the sound screen DFWM where enough pumping power is available for time reversed $\epsilon_{b1}(\epsilon_{b2})$ wave. In optics, a prove wave is required to create time reversed waves. VIII. The Relationship Between Driving Waves and Forced Bending Vibrations Left and right driving traveling sound waves $P_1$ and $P_2$ counter propagate with respect to each other within the screens. As a result, stationary standing waves are developed.

The bending wave vibrations of a screen of which vertical displacement $\eta$ is given by $$D\frac{\partial^4 \eta}{\partial x^4} + m\frac{\partial^2 \eta}{\partial t^2} = f\exp[i(\omega t - kx)] = p(x,o,t) \tag{15}$$

where $D = Eh^3/12(1 - \nu^2)$
$E$ = Young's modulus
$m$ = mass per unit length
$kx$ = $K$ vector × component
$p$ = dumping force
$\nu$ = Poisson'sratio
$f$ = external force per unit area
$\omega$ = sound angular frequency For more discussion on this, refer to F. Fahy p. 126, (3.42) and (3.45)

The thin plate is assumed uniform and infinite (this assumption is proper for the sound screen), therefore the solution must take the form $$\eta(x,1t) = \eta\exp[i(\omega t - K_x X] \tag{16}$$

Substituting this equation into Eq(15) yields $$DK_x^4 - \omega^2 (m + \rho/Kx) = 0 \tag{17}$$

r is the sound pressure imposed upon the screen by diffused sound wave $P_1$.

p.(x,o,t) is the dumping force which, in our case is negative dumping (excitation) force by diffused sound wave $P_2$, which is given by:

$$p(x,o,t) = \frac{\omega PC}{+(K^2 - L_x^2)}\exp[i(\omega t - K_x x)] \tag{18}$$

where $\rho$ is effective air density and $$C = i\omega\eta \tag{19}$$

C is the complex amplitude of the plate velocity perpendicular to the screen surface. As frequency increases, sound wave energy radiated from the screen increases non-linearly as $mc^2\alpha\rho\mu^2\eta^2$ . Bending vibration is in favor of higher frequencies. Put another way, the sound screen does appear to compensate for any power drop in high frequencies.

Eq(15) is for the stationary condition and application to non-stationary transitory multi-frequency sound waves must be carefully considered. Previously, in section III B, it was shown that within the time domain $\tau$ and space domain L one may consider distributed sound pressure of diffused sound waves as a temporal stationary state.

Assuming that input waves $P_1$ and $P_2$ are short pulse waves for which duration is less than $\tau$, then one may be express the $P_1$ and $P_2$ relation from Eq. 15 as follows:

$$D\frac{\partial^4}{\partial x^4}P_f^* + m\frac{\partial^2}{\partial \tau^2}P_f^* = (DK^2 - mw^2)P_f^* + \frac{wPCC^*}{I(K^2 - K_x^2)^{\frac{1}{2}}}P_{1,2} \tag{20a}$$

$C \propto \tau T$
and $\eta \propto P_f$ and $P_{1,2}$ where C is the coupling coefficient between $P_1$ and $P_2$, and from Eq(11)

$$D\frac{\partial^4}{\partial x^4}P_{1,2} + m\frac{\partial^2}{\partial t^2}P_{1.2} = (DK^4 - m\omega^2)P_{1,2} + \frac{\omega PCC}{\pm(K^2 - L_x^2)^{\frac{1}{2}}}P_f^* \tag{20b}$$

The calculation of fourth degree differential equation Eq(20) is complicated. Fourier transformation in time domain considering the broad band scattered w values, adds another dimension.

On the other hand our experiment indicates that $P_f$ and ($P_b$) conjugate waves do exist, so that the solution for Eq(20) should exist.

IX. Two-point Microphone Stereo System

Figure 28:
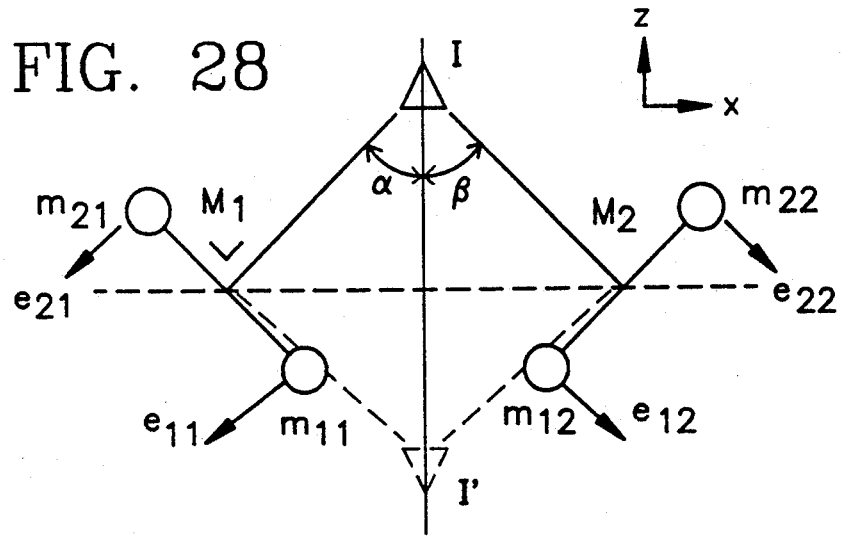
FIG. 28 illustrates the arrangement of direction sensitive microphones $M_1$ and $M_2$.

Eq (11) is taken under the assumption that $M_1$ and $M_2$microphones sense I as a vector. To fulfill this requirement, two-point microphones $M_1$ and $M_2$ shown in FIG. 28, are necessary.

This requirement is related to the requirement for system symmetry. The system equipped with two-point microphones $M_1$ and $M_2$could distinguish between left and right channels even if I is located on symmetry axis z as shown in FIG. 28. The electronic signals e21, $e_{11}$, $e_{12}$ and $e_{22}$ at $M_1$ and $M_2$ are all equal But once they are input to symmetric electronic circuits it becomes e21-($e_{11}$) $= -e_{22}(-e_{12})$.

Now, exchanging $M_1$ with $M_2$ (by translation but not by C2v rotation), then it becomes $e_{11} \neq e_{12}$, $e_{22} \neq e_{21}$. This did not happen with point microphones.

$M_1$ and $M_2$ can distinguish I against I, (mirror image of I, referred to x-y plane). This is important and necessary for recording the sound two dimensionally over $2\pi$ domain on x-z plane. For this, two symmetrically separated right and left channels for a total of four channels, are required. Naturally, the driver system is also required to have one symmetric left and right pair of two point drivers as shown in FIG. 29.

Figure 29:
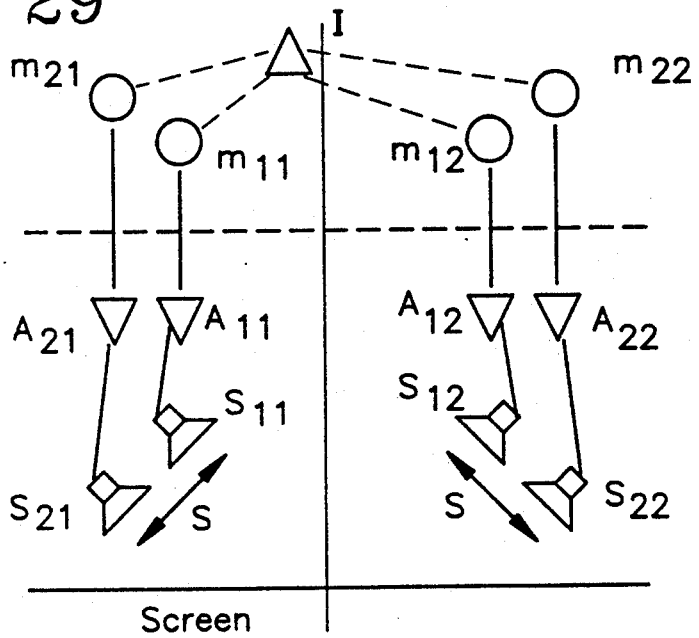
FIG. 29 illustrates a play-back system utilizing 2 point transducers.

In FIG. 29, each two-point microphone $M_{21}$-$M_{11}$, and $M_{12}$-$M_{22}$ senses the arrival time and the phase of the sound I differentially over $2\pi x-z$ plane.

On FIG. 29, the distance difference $\Delta 1 = 1_1 - 1$ between $M_{21} - M_{11}$ and I, $$\Delta l \left| \begin{array}{l} m_{21} = d\sin\delta \\ m_{11} = -d\left[\cos\gamma\left\{1-\left(\frac{\gamma}{l_1}\right)^2 \sin^2 x\right\}^{\frac{1}{2}} - \frac{\gamma}{l_1}\sin\chi\sin\gamma\right] \end{array} \right. \quad (21)$$

where $\gamma$, $\delta y$ and x are polar coordinates of I and where d is the separation between $m_{12}$ ($m_{21}$) and $m_{22}$ ($m_{11}$).

The relative phase shift of the signals I between $M_{11}$ ($M_{12}$) and $M_{21}$ (M22) is $$\Delta\phi = \frac{2\pi}{\lambda}\Delta l \text{ and } \Delta t = \frac{\Delta l}{C} \quad (22)$$

The magnitude and the sign of $\Delta\phi$ changes over x. z, $-$x.z, $x_{1-z}$ and $-x_{1-z}$ and x-z domains as shown in table 1.

TABLE 1

| | | |
|---|---|---|
| $-x,z$ | $x,z$ | |
| $-$ | $+$ | $\sin\gamma$ |
| | $+$ | $\sin\chi$ |
| | $-$ | $\sin\chi$ |
| $-$ | $+$ | $\cos\gamma$ |
| $-x,-z$ | $x,-z$ | |

X. Three Microphone Unit System

Extending the reasoning of the $2\pi$ two dimensional stereo system, it appears possible to construct truly $4\pi$ solid angle three dimensional systems.

Figure 30:
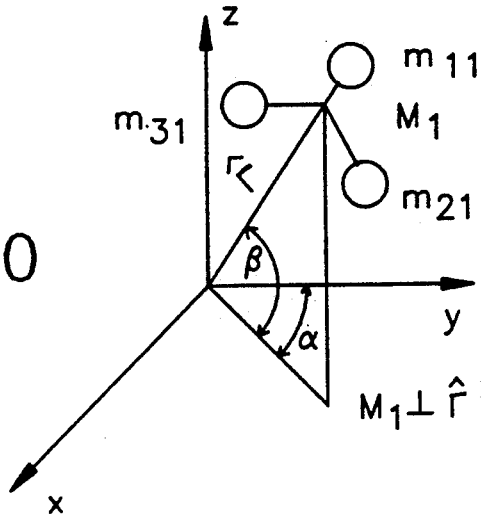
FIG. 30 illustrates diagrammatically the relationships between individual elements for a 3 point microphone system.

Two three point microphone units for L and R channel, two matched three point L and R drivers and L and R symmetric six channel sound mixers and amplifiers are required. The symmetry axis of each three point microphone and drivers must be inclined around 20–70 degrees against x, y and z axis so that I could be distinguishable from its mirror image I' thus avoiding the degeneration of symmetry, three dimensionally, as shown in FIG. 30.

The system becomes complicated as the channel number increases. However, possible implementations include:

Feeding two (2D) or three (3D) microphone output signals into two or even one amplifier per channel. Each driver has some capability to deliver the output to the screen in such a manner that the sound image on the screen duplicates the sound source at the studio and satisfies the symmetry requirement between input and output.

In case of a small 2D or 3D stereo unit, using two or three drivers integrated to one driver unit. Many configurations are possible.

On a 2D system, an elliptical speaker could be used to increase domain length L and time $\tau$. This may be particularly effective for smaller size speakers.

Figure 31:
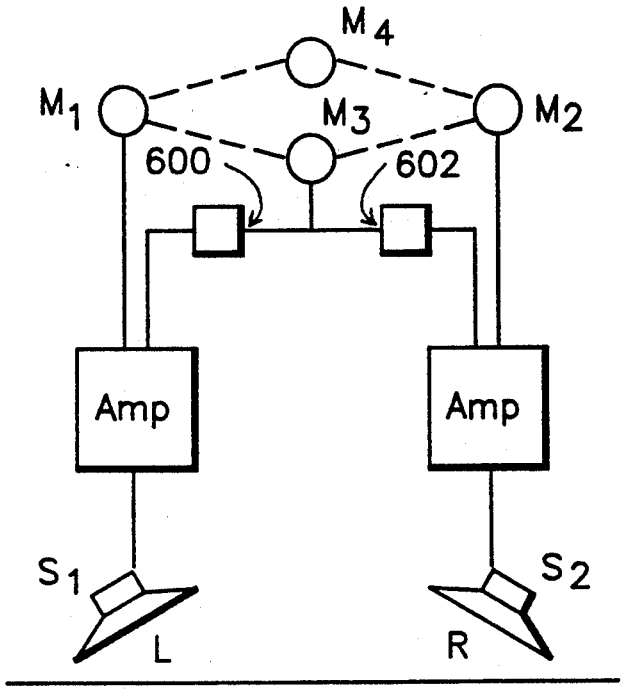
FIG. 31 illustrates a 3 microphone arrangement for reproduction of "$2\pi-2$ D" sound.

Finally, there is a possibility that a three microphone arrangement, as shown in FIG. 31 has the potential to reproduce $2\pi-2D$ sound.

This $M_1$-$M_3$-$M_2$or $M_1$-$M_4$-$M_2$ microphone arrangement may be used to record a large symphony with a solo singer or instrumentalist. $M_3$or ($M_4$) is for the soloist.

The plus and minus 90 degree phase shifters 600, 602 are critical elements of the system. A 0 and 180 degree phase shifter, attached to $M_3$, does not provide left and right symmetry.

$M_3$($M_4$) merge together with $M_1$ or $M_2$ in phase just as in the last section, on the $\alpha+\beta=0$ case.

The configuration of FIG. 31 is compared to conventional three microphone system in following section.

XI. Present Recording Technique

At present, the most common recording system in the studio is shown in FIG. 33. Both left and right channels are in phase. Note the Hilbert Transformer HT (Quadralizer) circuit has two phase shifters.

Figure 32:
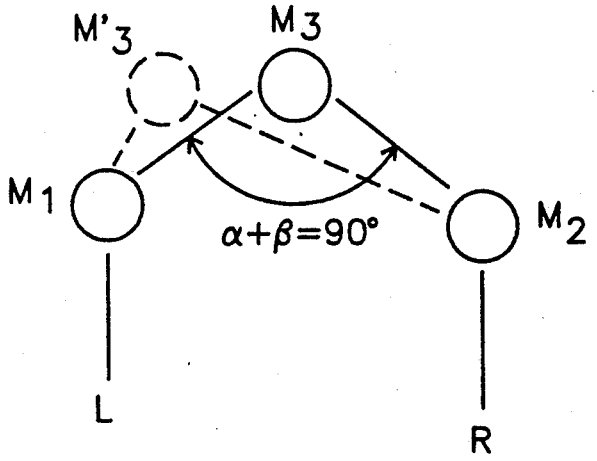
FIG. 32 illustrates a microphone arrangement which may be used to record a large symphony with a solo singer or instrumentalist.

Comparing the configuration of FIG. 33 to that of FIG. 31, the HT terminal S4 has only one 90 degree phase shifter in contrast to the $\alpha$(L) and $\beta$(R) phase shifters for the phase conjugate system. The objective of HT is to bring the $M_3$ image around to the center between $M_1$ and $M_2$. Such situations are depicted in FIG. 32.

FIG. 31 is an example of the mixture of the scalar system of $M_1$ and $M_2$ and the phase conjugate M3 input. With a sound screen, $M_3$ will be "displayed: in the middle of the screen. But if we reproduce such sound with a two-speaker system, stereo sensations are minimal because other sounds recorded by $M_1$ and $M_2$ are merely scalar stereo sounds.

Turning back to FIG. 33, it is shown that $S_3$, $S_2$ and $S_1$terminal connections are simply scalar connections Comparing $S_2$and $S_3$ with the present conjugate wave mixing method it appears the present method is more versatile and logical than the Hilbert transformation method.

Turning now to FIGS. 33 and 34, there is shown the conventional recording configuration for which $M_1$, $M_2$ and $M_3$ are in same phase. If the recording is done this way, the left and right amplifiers must be in phase. If the holographic speaker with the 180 degree out-of-phase symmetric amplifiers are to be used, then $M_3$ must be in-phase with $M_1$ and $M_2$.

Turning now to FIG. 35, there is shown the phase conjugate configuration. In the case of sound reproduction with a sound screen speaker, the sound image of a sound source in front of $M_3$could be located at any point within the $\pi$ z-x domain by adjusting angles $\alpha+\beta$ and $\alpha/\beta$.

Figure 36:
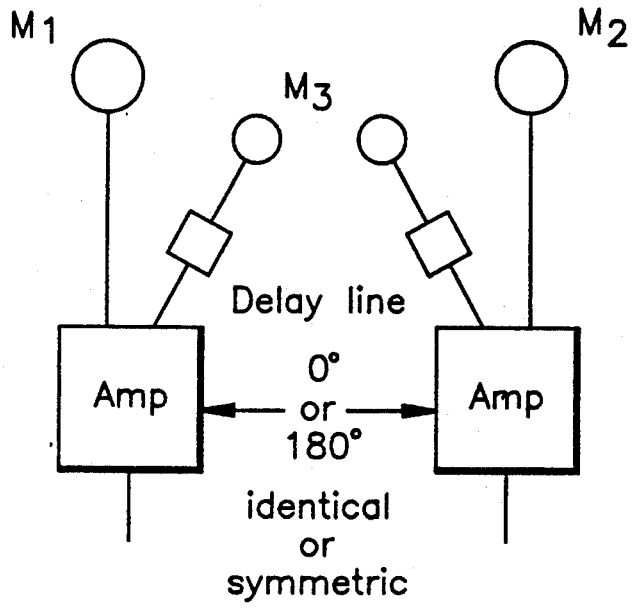
FIG. 36 illustrates a recording configuration for both phase conjugate and conventional systems.

XIII. Acceptable Recording Configuration for Both Phase Conjugate and Conventional Systems The configuration of FIG. 36 is suitable for both identical and symmetric systems. But the sound quality, image resolution, image view angle and position resolution are far superior with a holograph sound screen system.

XIV. The Differences Between Conventional Systems and Phase Conjugate Systems The case-by-case comparisons highlight the differences between them and will assist in understanding the phase conjugate system.

| Conventional | Phase Conjugate |
|---|---|
| L and R channel are in-phase. | L and R channel are conjugated (similar to 180 degree out of phase). |
| L and R identity is by the L and R sound volume balance. | L and R position identity is by holograph diffraction angle. |
| Space depth (Z-axis) control is by time lag of either natural or artificial origin. | Space depth inherent in holograph. |
| Interference R and L speaker spherical wave front interference (more interference with the out of phase case at the area between L and R speaker). | All interference takes place on the screen. The output wave from a screen is a plane wave and has the least interference. (The same case would apply with in-phase and out-of-phase L and R channels.) |
| Tone quality is totally controlled by each speakers characteristics. | Driving speaker characteristics are compensated for by the screen. True sound is created as a result of L and R sound correlation and convolution. |
| Aperture is limited by cone diameter. Sound is directional particularly at high frequencies. | A holograph is the spacial filter against non-correlated sound. This provides large speaker aperture and large frequency range. |
| Transient characteristics are limited by that of the speakers. | Transient characteristics are related to the position definition of the sound source on the screen. A better tonality is obtained with a fine holographic sound image. |
| 2D stereo is scalar in nature. Less than 90 degree coverage. | Stereo is the built-in nature of the holograph. It has 180 degree coverage and is expandable to 360 degrees. |
| 3D stereo is a multi-speaker system. Interference problems exist. | Single screen holographs could have $4\pi$ solid angle stereophonic functions, one set of speakers is sufficient. |

The phase conjugate system is easily converted to a conventional system by turning on and/or off the 180 phase inverter switch at the L or R electronic circuit. In either case, the sound screen could produce a better sound than in the conventional case as the sounds are plane waves and the interferences between them are minimal. It is also still a grating sound which is similar to a holograph. As a result, the sound quality is very good.

References 1. (a) Matthews ed (1977), "Surface Wave Filter" Wiley N.Y.
   (b) D. Casasent ed "Optical Data Processing", Vol. 23, Springer Verlag Berlin and N.Y.
2. J. Partin et al. (1979), "Holography in Medicine and Biography", G. Von Bally ed Optical Science, Vol. 18, p.
   73, Springer Verlag Berlin and N.Y.
3. J. M. Fournier (1977) "Application of Holograph" Pergamon, N.Y.
4. R. A. Fisher (1983), "Optical Phase Conjugate", Academic Press, N.Y.
5. F. Fahy (1985), "Sound Structural Vibration", Academic Press, N.Y.
6. H. Stark ed (1982), "Applications of Optical Fourier Tranforms", Academic Press, N.Y.
7. W. Lukosz (1968) "Equivalent-Lens Theory of Holographic Imaging" J. Opt. Soc. Am. 38, 1084.
8. J. J. Gerritsen (1967) "Nonlinear Effects in Image Formation" App. Phys. Lett. 10, 237.
9. D. L. Staebler and A. J. Amodei (1972) "Coupled Wave Analysis of Holographic Storage in $LiNbO_3$" J. App. Phys. 43, 1042.
10. T. R. O'Meara and A. Yariv (1982) "Time Domain Signal Processing via Four Wave Mixing in Nonlinear Delay Lines" Opt. Eng. 21, 237.

From the foregoing, it is apparent that the present invention provides an enhanced sonic illusion of a live performance. Although the invention has been disclosed in terms of a preferred embodiment, it should be understood that numerous variations and modifications could be made without departing from the true spirit and scope of the inventive concept as set forth in the following claims.

I claim:

1. A structure for producing an aural image at a listening position for stereophonic playback systems, comprising:

first and second loudspeakers producing a left channel sound wave and a right channel sound wave respectively;

a substantially planar sound screen having a periphery and having a first surface and an opposing second surface separated by a thickness equal to a fraction of a selected acoustic wavelength, said screen being divided into a plurality of zones with each zone being fabricated from a selected material;

support means for each of said plurality of sound screen zones for exerting selected tensile forces about the periphery of the sound screen zones;

means aiming said first loudspeaker to direct said left channel sound wave as a diffused sound incident upon a majority of the sound screen, thereby generating first forced bending waves of the screen, which propagate within the plane of the sound screen;

means aiming said second loudspeaker to direct said right channel sound wave as a diffused sound incident upon a majority of the sound screen, thereby generating second forced bending waves of the screen, which propagate within the plane of the sound screen;

said tensile forces being sufficient to cause said first and second forced bending waves to generate an interference within the sound screen, said interference generating an interference sound wave which propagates toward the listening position;

wherein each said sound screen zone produces an interference sound wave component in a selected distinct band of frequencies.

2. The structure of claim 1, wherein said left channel sound wave and said right channel sound wave are phase conjugated waves.

3. The structure of claim 1, further including an enclosure, said sound screen being affixed to said enclosure and said first and second transducers being positioned within said enclosure.

4. The structure of claim 1, wherein said first and second loudspeakers direct said left channel sound wave and said right channel sound wave onto said first sound screen surface and wherein said sound screen is situated to propagate said interference sound wave toward the listening position from said second sound screen surface.

5. The structure of claim 1, wherein said first and second transducers are situated to provide said left channel sound wave and said right channel sound wave incident upon said first sound screen surface and wherein the sound screen is situated to propagate the interference sound wave toward the listening position from said first sound screen surface.

6. The structure of claim 1, wherein said plurality of zones includes a first zone for high frequencies and a second zone for low frequencies, the high frequency sound screen zone being fabricated from a metallic foil and the low frequency sound screen zone being fabricated from a woven cloth.

7. The structure of claim 6 wherein the woven cloth is canvas.

8. The structure of claim 6, wherein the metallic foil is aluminum foil.

9. A system for reproduction of an audio program which preserves the relative position of each sound source in the programs aural image, comprising:

a first two-point microphone for converting a first two-dimensional vector sound wave to a first two-dimensional vector electronic wave;

a second two-point microphone for converting a second two-dimensional vector sound wave to a second two-dimensional vector electronic wave;

a first two-point loudspeaker for converting said first two-dimensional vector electronic wave into a left channel sound wave;

a second two-point loudspeaker for converting said second two-dimensional vector electronic wave into a right channel sound wave;

a substantially planar sound screen having a periphery and having a first surface and an opposing second surface separated by a thickness equal to a fraction of a selected acoustic wavelength;

support means for exerting tensile forces about the periphery of the sound screen;

means aiming said first two-point loudspeaker to direct said left channel sound wave as a diffused sound incident upon a majority of the sound screen, thereby generating first forced bending waves of the screen, which propagate within the plane of the sound screen;

means aiming said second two-point loudspeaker to direct said right channel sound wave as a diffused sound incident upon a majority of the sound screen, thereby generating second forced bending waves of the screen, which propagate within the plane of the sound screen;

said tensile forces being sufficient to cause said first and second forced bending waves to generate an interference within the sound screen, said interference generating an interference sound wave which propagates toward the listening position.

* * * * *